US011015892B1

(12) United States Patent
Jessup et al.

(10) Patent No.: US 11,015,892 B1
(45) Date of Patent: May 25, 2021

(54) ANTI-DRY-FIRE MECHANISM FOR A CROSSBOW

(71) Applicant: Excalibur Crossbow, Inc., Kitchener (CA)

(72) Inventors: Cole J. Jessup, Waterloo (CA); Kyle William Egerdee, Fergus (CA); Stephen Donald Langdon, Arthur (CA)

(73) Assignee: EXCALIBUR CROSSBOW, INC., Eugene, OR (US)

( * ) Notice: Subject to any disclaimer, the term of this patent is extended or adjusted under 35 U.S.C. 154(b) by 0 days.

(21) Appl. No.: 16/858,630

(22) Filed: Apr. 26, 2020

(51) Int. Cl.
*F41B 5/12* (2006.01)
*F41A 17/20* (2006.01)
*F41B 5/14* (2006.01)

(52) U.S. Cl.
CPC ..... *F41A 17/20* (2013.01); *F41B 5/12* (2013.01); *F41B 5/1469* (2013.01)

(58) Field of Classification Search
CPC ..... F41B 5/12
See application file for complete search history.

(56) References Cited

U.S. PATENT DOCUMENTS 2,786,461 A 3/1957 Pelsue
3,043,287 A 7/1962 Nelson
3,561,419 A 2/1971 Cucuzza
3,670,711 A 6/1972 Firestone
4,593,675 A 6/1986 Waiser
4,603,676 A 8/1986 Luoma
4,649,892 A 3/1987 Bozek
4,697,571 A 10/1987 Waiser
4,719,897 A 1/1988 Gaudreau
4,942,861 A 7/1990 Bozek
5,085,200 A 2/1992 Horton-Corcoran et al.
5,115,795 A 5/1992 Farris
5,220,906 A 6/1993 Choma
5,598,829 A 2/1997 Bednar
5,649,520 A 7/1997 Bednar
5,823,172 A 10/1998 Suggitt
5,884,614 A 3/1999 Darlington et al.
6,095,128 A 8/2000 Bednar
6,205,990 B1 3/2001 Adkins
6,286,496 B1 9/2001 Bednar
6,736,123 B1 5/2004 Summers et al.
(Continued)

*Primary Examiner* — John A Ricci
(74) *Attorney, Agent, or Firm* — Husch Blackwell LLP

(57) ABSTRACT

An anti-dry-fire mechanism for a crossbow includes a slotted mainframe and a movable trigger subassembly engaged with the slot for bidirectional movement between brace and drawn positions. The movable subassembly includes a bowstring latch forward of a bowstring catch and biased toward a bolt-absent position in which the bowstring latch obstructs forward movement of the bowstring past the bowstring latch; in its bolt-present position the bowstring latch permits such movement. With the movable subassembly in the drawn position, a bolt loaded onto the mainframe holds the bowstring latch in its bolt-present position against its bias; with the movable subassembly in the drawn position and no bolt loaded, the bowstring latch is held in its bolt-absent position by its bias. With the movable subassembly in the brace position, engagement of the mainframe and bowstring latch holds the bowstring latch in its bolt-present position against its bias.

19 Claims, 22 Drawing Sheets

(56) References Cited

U.S. PATENT DOCUMENTS

| | | | | |
|---|---|---|---|---|
| 6,799,566 | B1 | 10/2004 | Malucelli | |
| 6,802,304 | B1 | 10/2004 | Chang | |
| 6,913,007 | B2 | 7/2005 | Bednar | |
| 7,100,590 | B2 | 9/2006 | Chang | |
| 7,770,567 | B1 | 8/2010 | Yehle | |
| 7,784,453 | B1 | 8/2010 | Yehle | |
| 8,104,461 | B2 | 1/2012 | Kempf | |
| 8,240,299 | B2 | 8/2012 | Kronengold et al. | |
| 8,443,790 | B2 | 5/2013 | Pestrue | |
| 8,453,631 | B1 | 6/2013 | Kronengold et al. | |
| 8,499,753 | B2 | 8/2013 | Bednar et al. | |
| 8,578,917 | B2 | 11/2013 | Bednar et al. | |
| 8,899,217 | B2 | 12/2014 | Islas | |
| 8,950,385 | B1 | 2/2015 | Khoshnood | |
| 9,010,308 | B1 | 4/2015 | Hyde et al. | |
| 9,140,516 | B1 | 9/2015 | Hyde | |
| 9,255,754 | B1 * | 2/2016 | Kempf | F41B 5/12 |
| 9,303,944 | B2 | 4/2016 | Barber | |
| 9,341,432 | B1 | 5/2016 | Wohleb | |
| 9,341,434 | B2 | 5/2016 | McPherson et al. | |
| 9,383,159 | B2 | 7/2016 | Pulkrabek et al. | |
| 9,404,706 | B2 | 8/2016 | Khoshnood | |
| 9,494,380 | B1 | 11/2016 | Yehle | |
| 9,528,792 | B1 | 12/2016 | Chang | |
| 9,958,232 | B1 | 5/2018 | Egerdee et al. | |
| 10,012,468 | B1 * | 7/2018 | Kempf | F41B 5/12 |
| 2002/0059924 | A1 | 5/2002 | Bednar | |
| 2004/0194771 | A1 | 10/2004 | Maincelli | |
| 2005/0022799 | A1 | 2/2005 | Bednar | |
| 2006/0086346 | A1 | 4/2006 | Middleton | |
| 2006/0144380 | A1 | 7/2006 | Kempf | |
| 2006/0169258 | A1 | 8/2006 | Chang | |
| 2010/0170488 | A1 | 7/2010 | Rasor et al. | |

* cited by examiner

ANTI-DRY-FIRE MECHANISM FOR A CROSSBOW

FIELD OF THE INVENTION

The field of the present invention relates to crossbows. In particular, an inventive anti-dry-fire mechanism for a crossbow is disclosed.

BACKGROUND

A wide variety of crossbows have been disclosed previously; some of those are disclosed in:

U.S. Pat. No. 2,786,461 entitled "Cross bow pistol" issued Mar. 26, 1957 to Pelsue;

U.S. Pat. No. 3,043,287 entitled "Crossbow cocking device" issued Jul. 10, 1962 to Nelson;

U.S. Pat. No. 3,561,419 entitled "Cross bow with pneumatic cooking assembly" issued Feb. 9, 1971 to Cucuzza;

U.S. Pat. No. 3,670,711 entitled "Crossbow cocking device" issued Jun. 20, 1972 to Firestone;

U.S. Pat. No. 4,593,675 entitled "Cross bows" issued Jun. 10, 1986 to Waiser;

U.S. Pat. No. 4,603,676 entitled "Bow drawback mechanism" issued Aug. 5, 1986 to Luoma;

U.S. Pat. No. 4,649,892 entitled "Cross bow with cocking mechanism" issued Mar. 17, 1987 to Bozek;

U.S. Pat. No. 4,697,571 entitled "Cross bows" issued Oct. 6, 1987 to Waiser;

U.S. Pat. No. 4,719,897 entitled "Cocking mechanism for crossbow" issued Jan. 19, 1988 to Gaudreau;

U.S. Pat. No. 4,942,861 entitled "Cross bow with improved cocking mechanism" issued Jul. 24, 1990 to Bozek;

U.S. Pat. No. 5,085,200 entitled "Self-actuating, dry-fire prevention safety device for a crossbow" issued Feb. 4, 1992 to Horton-Corcoran et al;

U.S. Pat. No. 5,115,795 entitled "Crossbow cocking device" issued May 26, 1992 to Farris;

U.S. Pat. No. 5,220,906 entitled "Device to draw the bowstring of a crossbow" issued Jun. 22, 1993 to Choma;

U.S. Pat. No. 5,598,829 entitled "Crossbow dry fire prevention device" issued Feb. 4, 1997 to Bednar;

U.S. Pat. No. 5,649,520 entitled "Crossbow trigger mechanism" issued Jul. 22, 1997 to Bednar;

U.S. Pat. No. 5,823,172 entitled "Crossbow bow string drawing device" issued Oct. 20, 1998 to Suggitt;

U.S. Pat. No. 5,884,614 entitled "Crossbow with improved trigger mechanism" issued Mar. 23, 1999 to Darlington et al;

U.S. Pat. No. 6,095,128 entitled "Crossbow bowstring drawing mechanisms" issued Aug. 1, 2000 to Bednar;

U.S. Pat. No. 6,205,990 entitled "Dry-fire prevention mechanism for crossbows" issued Mar. 27, 2001 to Adkins;

U.S. Pat. No. 6,286,496 entitled "Crossbow bowstring drawing mechanism" issued Sep. 11, 2001 to Bednar;

U.S. Pat. No. 6,736,123 entitled "Crossbow trigger" issued May 18, 2004 to Summers et al;

U.S. Pat. No. 6,799,566 entitled "Automatic cocking device in a crossbow for hunting and archery" issued Oct. 5, 2004 to Malucelli;

U.S. Pat. No. 6,802,304 entitled "Trigger assembly with a safety device for a crossbow" issued Oct. 12, 2004 to Chang;

U.S. Pat. No. 6,913,007 entitled "Crossbow bowstring drawing mechanism" issued Jul. 5, 2005 to Bednar;

U.S. Pat. No. 7,100,590 entitled "Bowstring drawing device for a crossbow" issued Sep. 5, 2006 to Chang;

U.S. Pat. No. 7,770,567 entitled "Safety trigger for a crossbow" issued Aug. 10, 2010 to Yehle;

U.S. Pat. No. 7,784,453 entitled "Draw mechanism for a crossbow" issued Aug. 31, 2010 to Yehle;

U.S. Pat. No. 8,104,461 entitled "Crossbow cocking assembly" issued Jan. 31, 2012 to Kempf;

U.S. Pat. No. 8,240,299 entitled "Release assembly for crossbow" issued Aug. 14, 2012 to Kronengold et al;

U.S. Pat. No. 8,443,790 entitled "Cocking winch apparatus for a crossbow, crossbow system including the cocking winch apparatus, and method of using same" issued May 21, 2013 to Pestrue;

U.S. Pat. No. 8,453,631 entitled "Release assembly for crossbow" issued Jun. 4, 2013 to Kronengold et al;

U.S. Pat. No. 8,499,753 entitled "Integrated cocking device" issued Aug. 6, 2013 to Bednar et al;

U.S. Pat. No. 8,578,917 entitled "Slip clutch" issued Nov. 12, 2013 to Bednar et al;

U.S. Pat. No. 8,899,217 entitled "Bowstring cam arrangement for compound long bow or crossbow" issued Dec. 2, 2014 to Islas;

U.S. Pat. No. 8,950,385 entitled "Crossbow with a crank cocking and release mechanism" issued Feb. 10, 2015 to Khoshnood;

U.S. Pat. No. 9,010,308 entitled "Trigger mechanism for a crossbow" issued Apr. 21, 2015 to Hyde et al;

U.S. Pat. No. 9,140,516 entitled "Trigger mechanism for a crossbow" issued Sep. 22, 2015 to Hyde;

U.S. Pat. No. 9,303,944 entitled "Crossbow with integrated decocking device" issued Apr. 5, 2016 to Barber;

U.S. Pat. No. 9,341,432 entitled "Drawstring cocking assembly" issued May 17, 2016 to Wohleb;

U.S. Pat. No. 9,341,434 entitled "Crossbow cocking crank" issued May 17, 2016 to McPherson et al;

U.S. Pat. No. 9,383,159 entitled "De-cocking mechanism for a bow" issued Jul. 5, 2016 to Pulkrabek et al;

U.S. Pat. No. 9,404,706 entitled "Crossbow with a crank cocking and release mechanism" issued Aug. 2, 2016 to Khoshnood;

U.S. Pat. No. 9,494,380 entitled "String control system for a crossbow" issued Nov. 15, 2016 to Yehle;

U.S. Pat. No. 9,528,792 entitled "Crossbow" issued Dec. 27, 2016 to Chang;

U.S. Pat. No. 9,958,232 entitled "Mechanism for drawing, cocking, and triggering a crossbow" issued May 1, 2018 to Egerdee et al;

U.S. Pub. No. 2002/0059924 entitled "Crossbow bowstring drawing mechanism" published May 23, 2002 in the name of Bednar;

U.S. Pub. No. 2004/0194771 entitled "Automatic cocking device in a crossbow for hunting and archery" published Oct. 7, 2004 in the name of Malucelli;

U.S. Pub. No. 2005/0022799 entitled "Crossbow rope cocking device" published Feb. 3, 2005 in the name of Bednar;

U.S. Pub. No. 2006/0086346 entitled "Crossbow cocking and stringing device" published Apr. 27, 2006 in the name of Middleton;

U.S. Pub. No. 2006/0144380 entitled "Crossbow" published Jul. 6, 2006 in the name of Kempf;

U.S. Pub. No. 2006/0169258 entitled "Bowstring drawing device for a crossbow" published Aug. 3, 2006 in the name of Chang; and U.S. Pub. No. 2010/0170488 entitled "Compact winding mechanism for crossbow" published Jul. 8, 2010 in the names of Rasor et al.

Each of the references identified above is incorporated by reference as if fully set forth herein.

SUMMARY

An inventive anti-dry-fire mechanism for a crossbow comprises an elongated mainframe of the crossbow and a movable trigger subassembly of the crossbow. The mainframe has a longitudinal slot, and the movable trigger subassembly includes a body engaged with the slot of the mainframe to enable bidirectional movement of the movable trigger subassembly along the mainframe between a forward brace position and a rearward drawn position. The movable trigger subassembly further includes a bowstring catch and a bowstring latch. The bowstring catch is movable between firing and non-firing catch positions. In its non-firing catch position the bowstring catch retains a bowstring of the crossbow; in its firing catch position the bowstring catch releases the bowstring. The bowstring latch is positioned forward of the bowstring catch, movable between bolt-present and bolt-absent positions, and biased toward the bolt-absent position. In its bolt-absent position the bowstring latch obstructs forward movement of the bowstring past the bowstring latch; in its bolt-present position the bowstring latch does not obstruct forward movement of the bowstring past the bowstring latch. With the movable trigger subassembly in the drawn position and a bolt loaded onto the mainframe and positioned over the bowstring latch, the bolt holds the bowstring latch in its bolt-present position against bias on the bowstring latch; with the movable trigger subassembly in the drawn position and no bolt loaded onto the mainframe, the bowstring latch is held in its bolt-absent position by the bias on the bowstring latch. With the movable trigger subassembly in the brace position, engagement (direct or indirect) of the mainframe with the bowstring latch holds the bowstring latch in its bolt-present position against the bias on the bowstring latch.

The mainframe can include an engagement surface that engages the bowstring latch, as the movable trigger subassembly moves to the brace position, and forces the bowstring latch to its bolt-present position against its bias; that engagement surface can be curved, sloped, inclined, or beveled. The mainframe and the bowstring latch can be engaged directly or indirectly. For indirect engagement the movable trigger subassembly can include a latch lever movable between engaged and non-engaged positions. In its non-engaged position the latch lever permits the bowstring latch to move to the bolt-absent position; in its engaged position the latch lever holds the bowstring latch in the bolt-present position against the bias on the bowstring latch. With the movable trigger subassembly in the drawn position, the latch lever is in the non-engaged position; with the movable trigger subassembly in the brace position, engagement of the latch lever with the mainframe holds the latch lever in the engaged position, thereby indirectly engaging the mainframe with the bowstring latch and holding the bowstring latch in the bolt-present position against the bias on the bowstring latch. The latch lever can include an engagement surface that engages the mainframe, as the movable trigger subassembly moves to the brace position, and forces movement of the bowstring latch to the bolt-present position against the bias on the bowstring latch; that engagement surface can be curved, sloped, inclined, or beveled An inventive crossbow includes the above mechanism and further comprises a stock subassembly that includes the mainframe, a stationary trigger subassembly attached at a rearward end of the mainframe, a pair of bow limbs attached to a forward portion of the mainframe and disposed on opposite sides of the mainframe, and a bowstring connected to ends of the bow limbs. The crossbow can be arranged as a recurve crossbow, or as a compound crossbow with additional cables and pulley members rotatably mounted on the limbs. The crossbow can include a trigger latch that, in its latched position, obstructs movement of the movable trigger subassembly from the drawn position. The crossbow can include a safety member that, in its safety-on position, prevents movement of a sear and firing of the crossbow. The crossbow can include a winch subassembly for taking up a rope attached to the movable trigger subassembly to draw the crossbow.

Objects and advantages pertaining to crossbows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
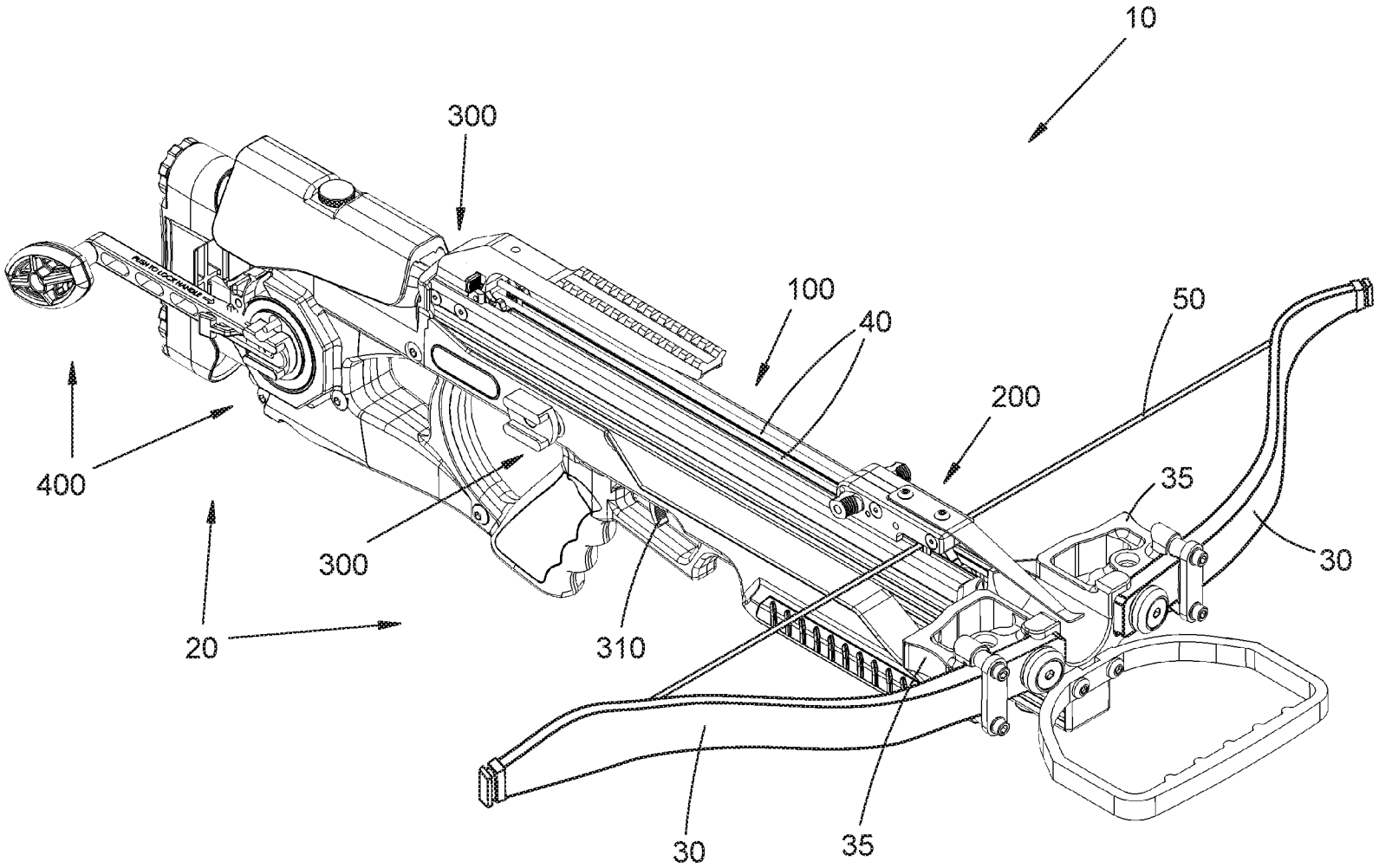
FIGS. 1 and 2 illustrate a crossbow including an inventive anti-dry-fire mechanism for a crossbow, with the crossbow at brace and at full draw, respectively.

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims. In the drawings, the heavy arrows indicate the movements of the various parts of the trigger assembly mechanism. Single-headed arrows indicate that the designated motion is permitted in both directions but is directly biased in the direction of the single arrowhead. Directly biased means that a suitable bias mechanism (including for example a torsion spring, linear spring, some other resilient member, magnets, a weight, an actuator, or some other suitable biasing element or means) is arranged to act directly on that part, and is what is meant when an element, part, or member is described as biased in a particular direction. Biasing elements such as springs are omitted from the Drawings for clarity. Double-headed arrows indicate that the designated motion of the corresponding part is permitted in both directions and is not directly biased in either direction. However, a non-biased part can be indirectly biased by bias or movement of other adjacent parts.

DETAILED DESCRIPTION OF EMBODIMENTS

Figure 2:
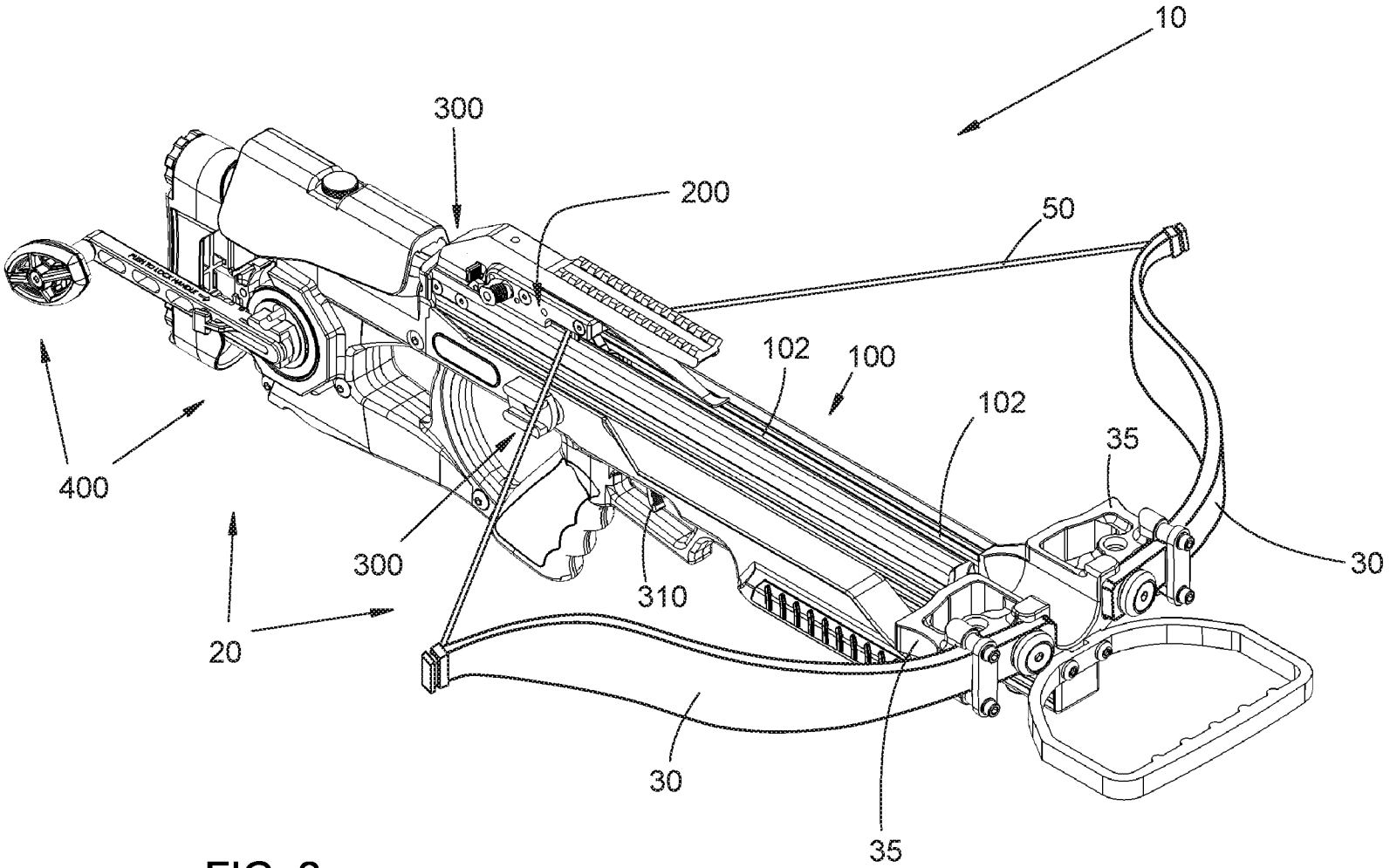

An example of a crossbow 10 is shown in FIGS. 1 and 2 at brace and at full draw, respectively. The crossbow 10 comprises a stock subassembly 20, a pair of bow limbs 30, a bowstring 50 connected to the ends of the bow limbs 30, a stationary trigger subassembly 300, and a movable trigger subassembly 200. A forward portion of the stock subassembly 20 includes an elongated mainframe 100 with a longitudinal slot 102 along its top surface. The bow limbs 30 are connected to a forward portion of the mainframe 100 and disposed on opposite sides of the mainframe 100, and the bowstring 50 connected to ends of the bow limbs 30. In some examples each limb 30 of the pair is a single so-called solid limb (as shown); in other examples, each limb 30 of the pair is a so-called split limb (not shown) comprising a pair of spaced-apart limb members. In some examples the bow limbs 30 are connected directly to the forward portion of the mainframe 100. In other examples, including the example shown, the crossbow 10 includes a riser 35 connected directly to the forward portion of the mainframe 100, with the bow limbs 30 connected to the riser 35. In some examples, including the example shown, the bow limbs 30 are arranged so that the crossbow 10 is arranged as a recurve crossbow. In some examples, the crossbow 10 includes a pair of pulley members and one or more cables coupled to one or both pulley members or to the bow limbs 30, the mainframe 100, or the riser 35 (if present). Each pulley member is rotatably mounted on a corresponding one of the bow limbs 30, and the bowstring 50 and the one or more cables are each engaged with one or both pulley members so that the crossbow 10 is arranged as a compound crossbow.

Figure 4A:
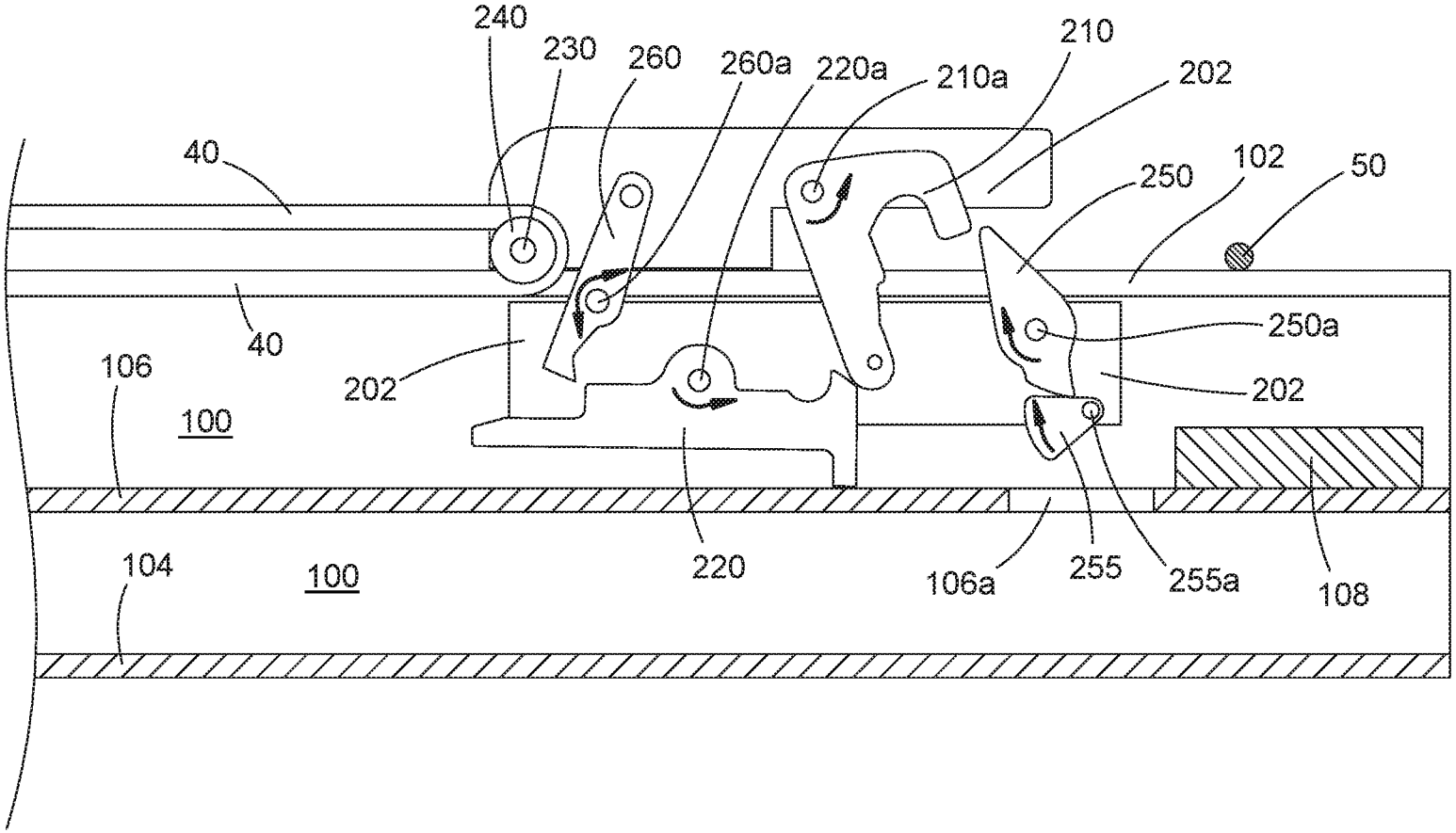
FIGS. 4A through 4I are schematic, partially cross sectional, side views of the inventive anti-dry-fire mechanism of FIG. 3, illustrating a sequence for using the crossbow properly.
Figure 4B:
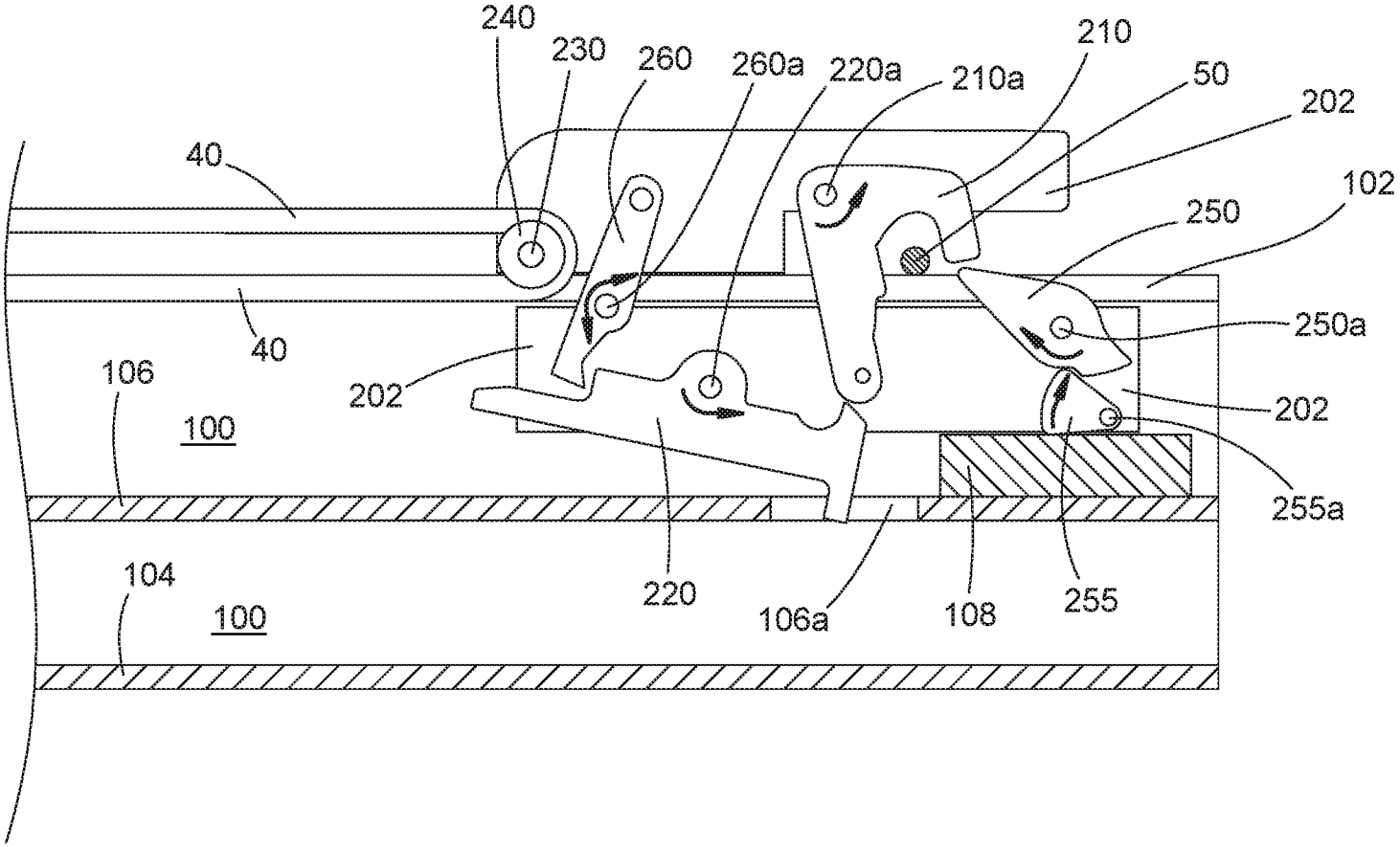
Figure 4C:
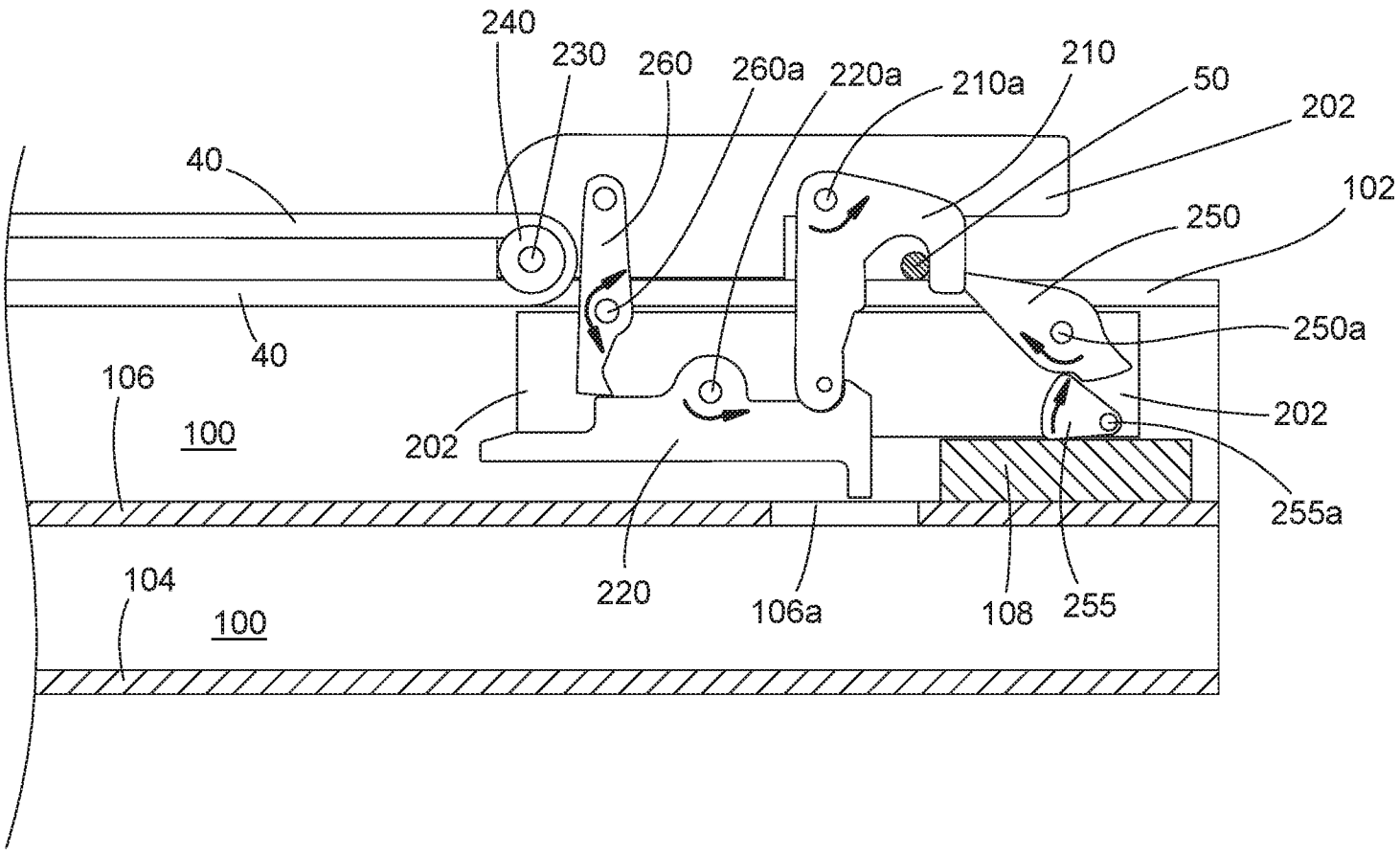
Figure 4D:
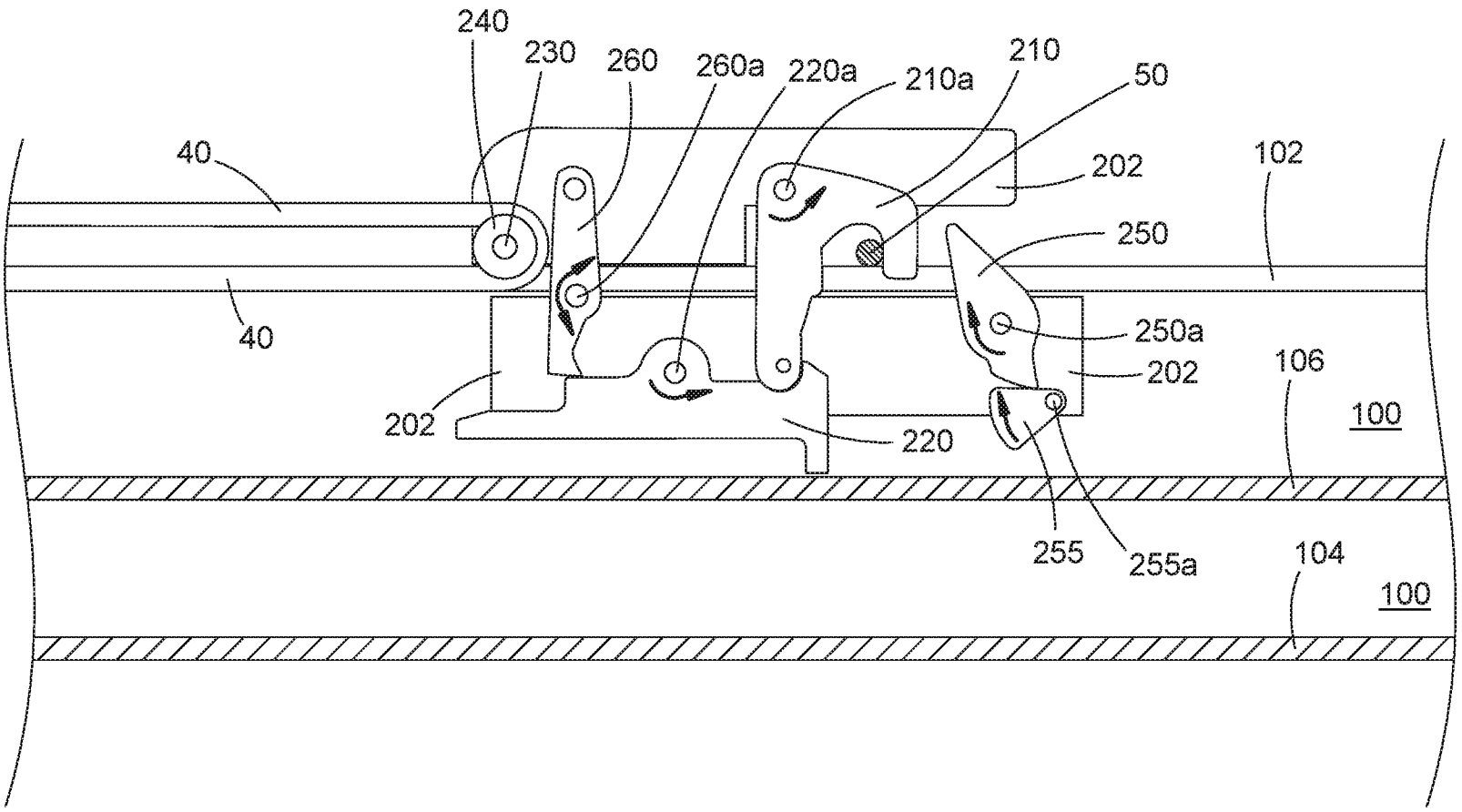
Figure 4E:
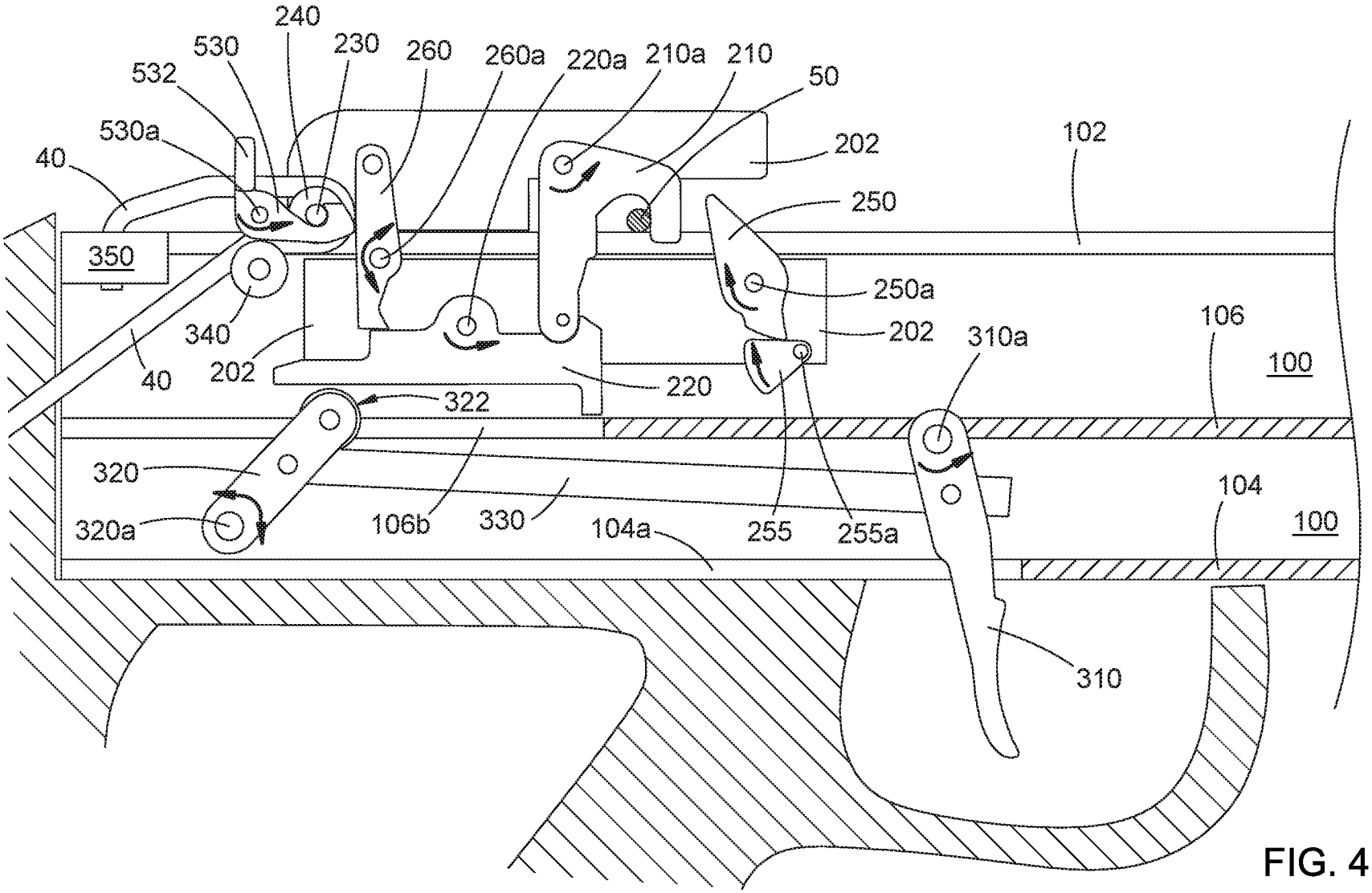
Figure 4F:
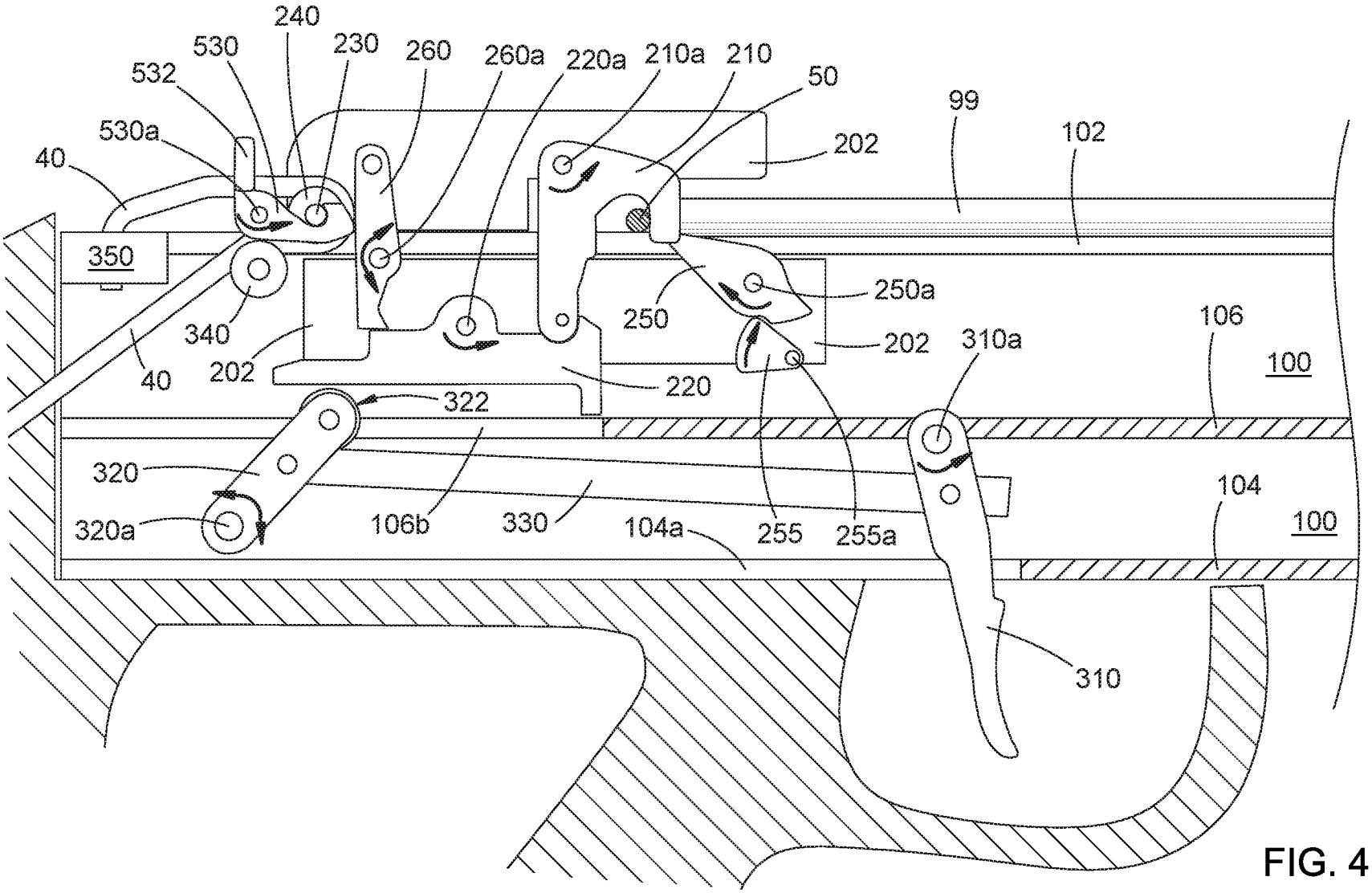
Figure 4G:
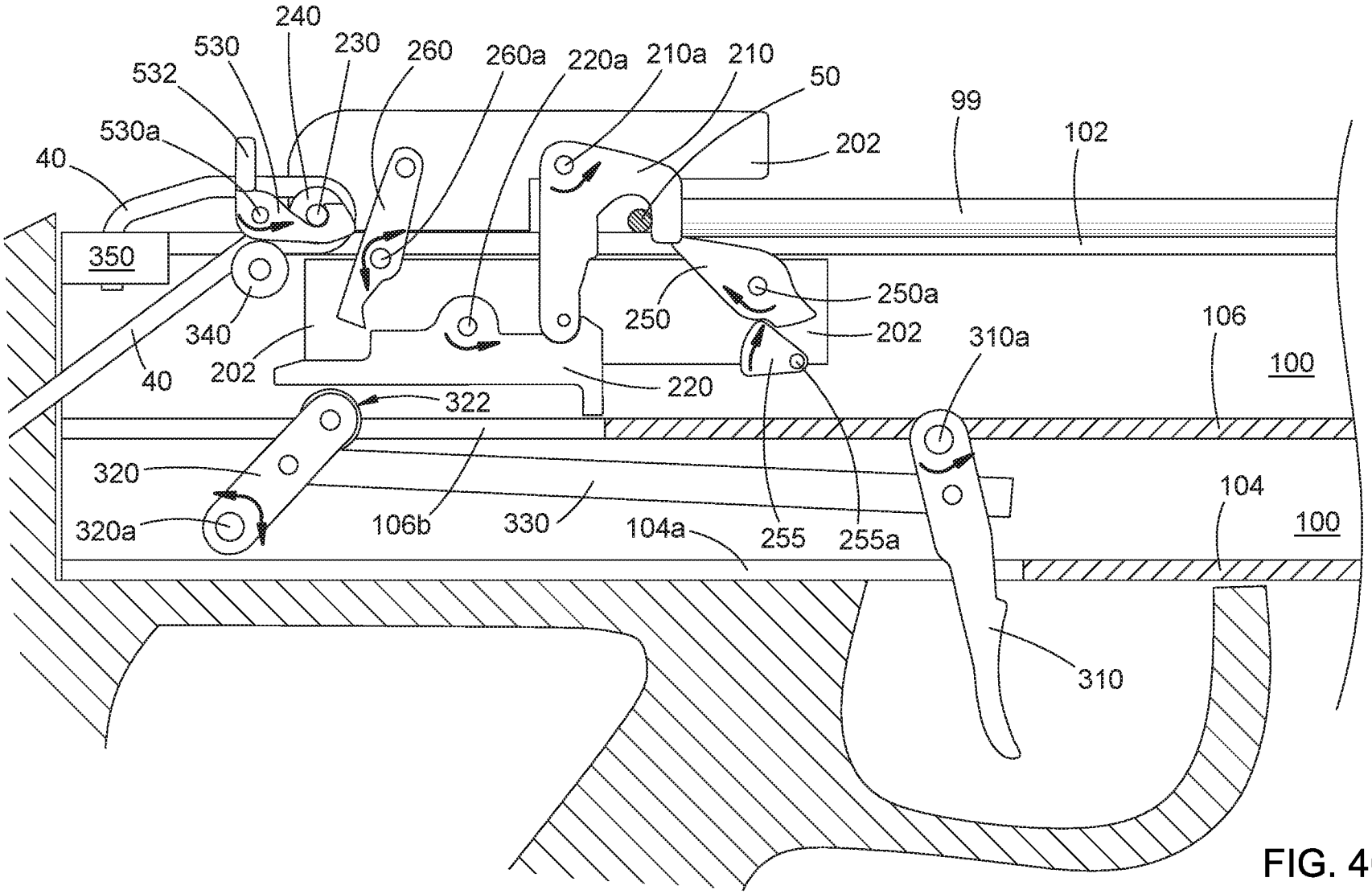
Figure 4H:
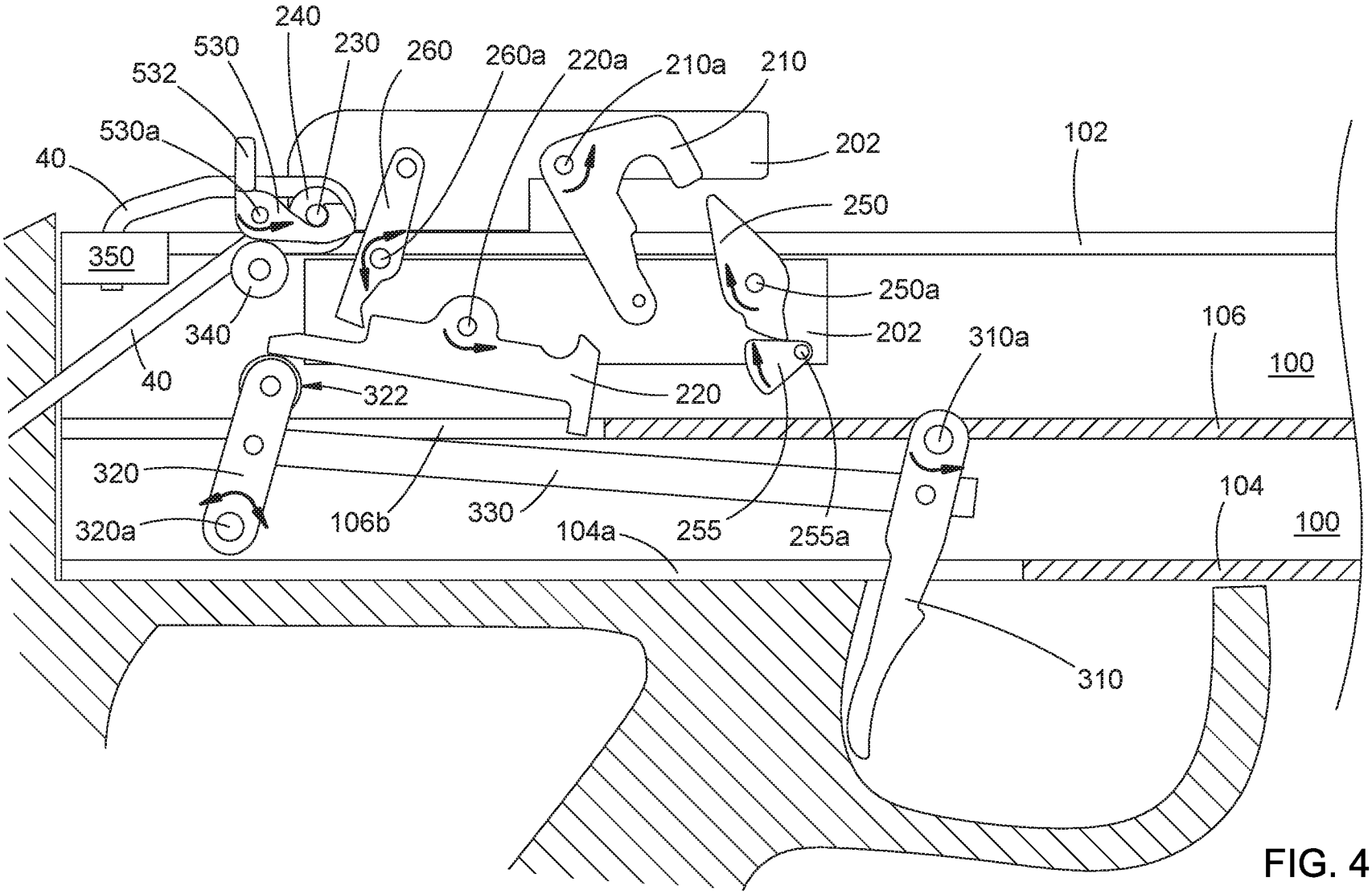
Figure 4I:
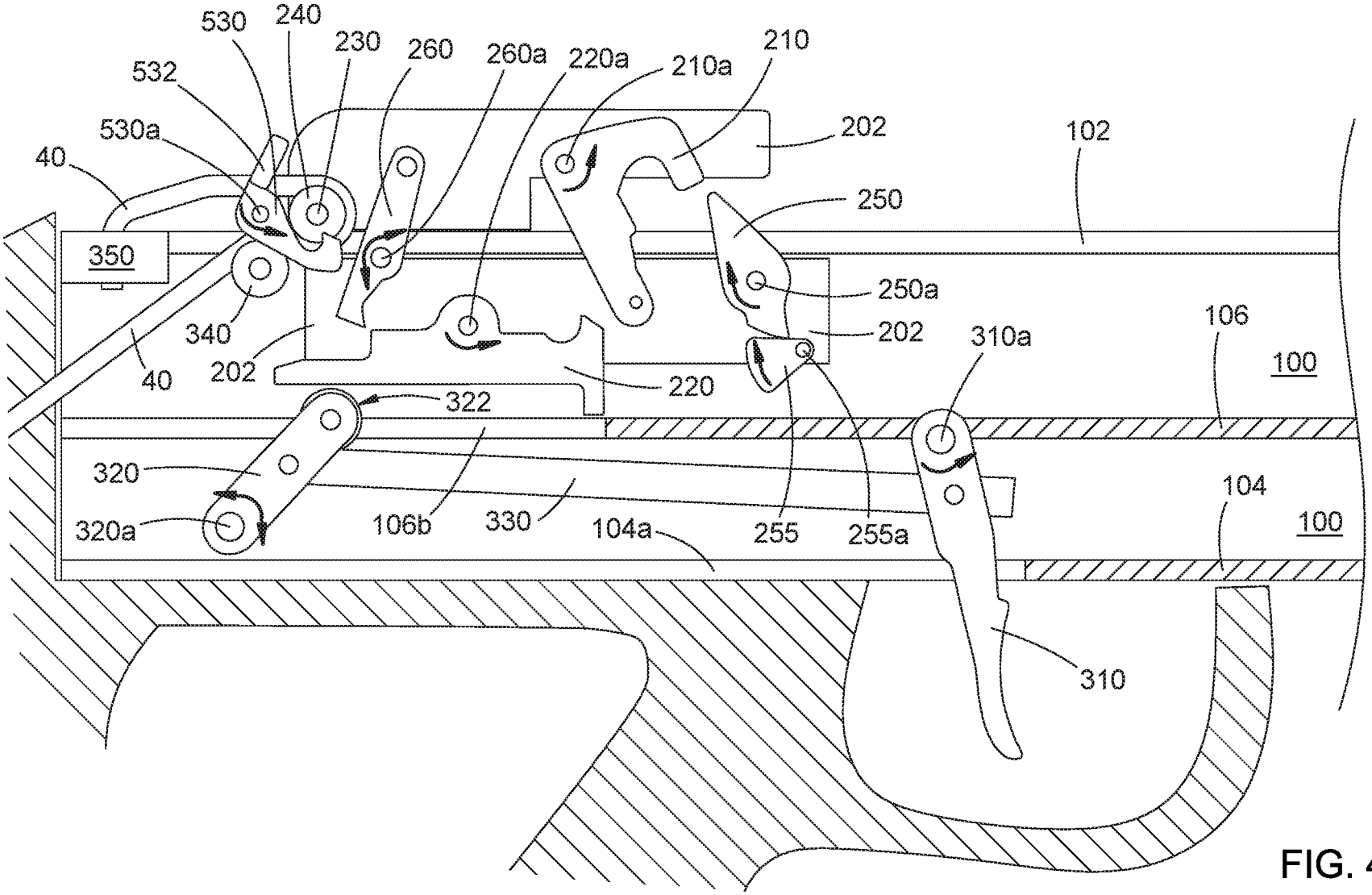
Figure 5:
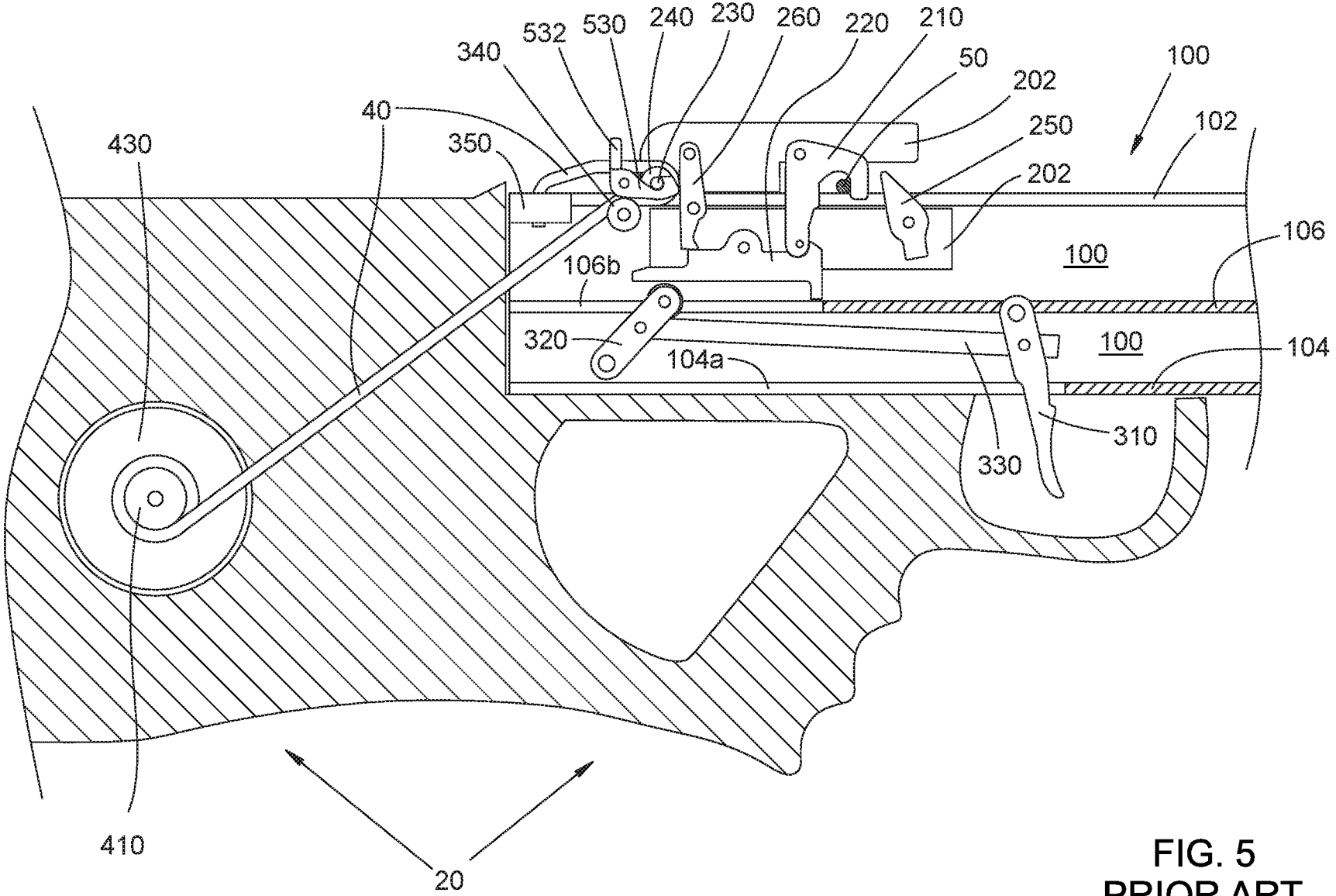
FIG. 5 PRIOR ART
FIG. 5 is a schematic, partially cross sectional, side view of a conventional anti-dry-fire mechanism for the crossbow, with the crossbow at full draw.
Figure 6A:
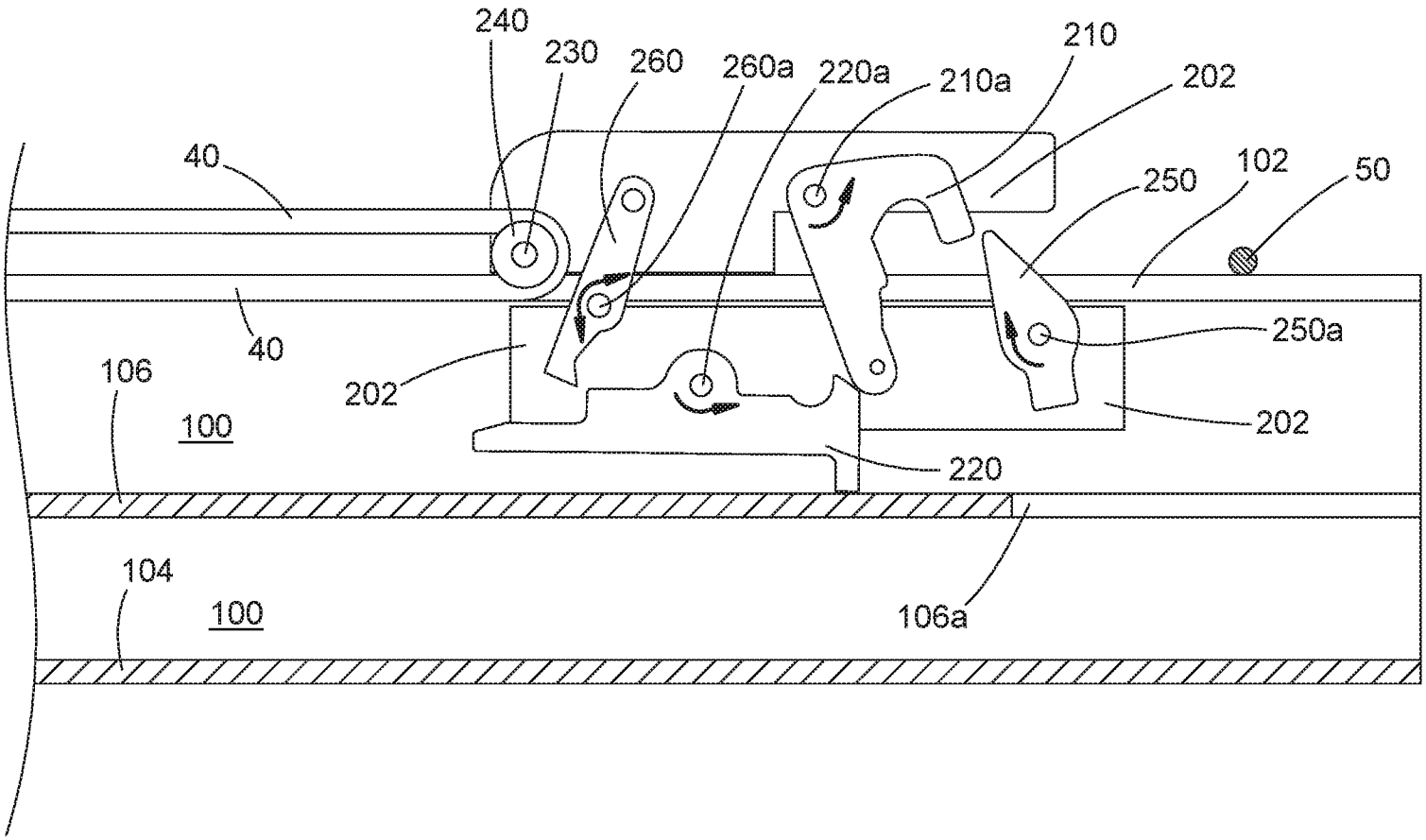
FIG. 6A PRIOR ART
FIGS. 6A through 6I are schematic, partially cross sectional, side views of the conventional anti-dry-fire mechanism of FIG. 5, illustrating a sequence for using the crossbow improperly.
Figure 6B:
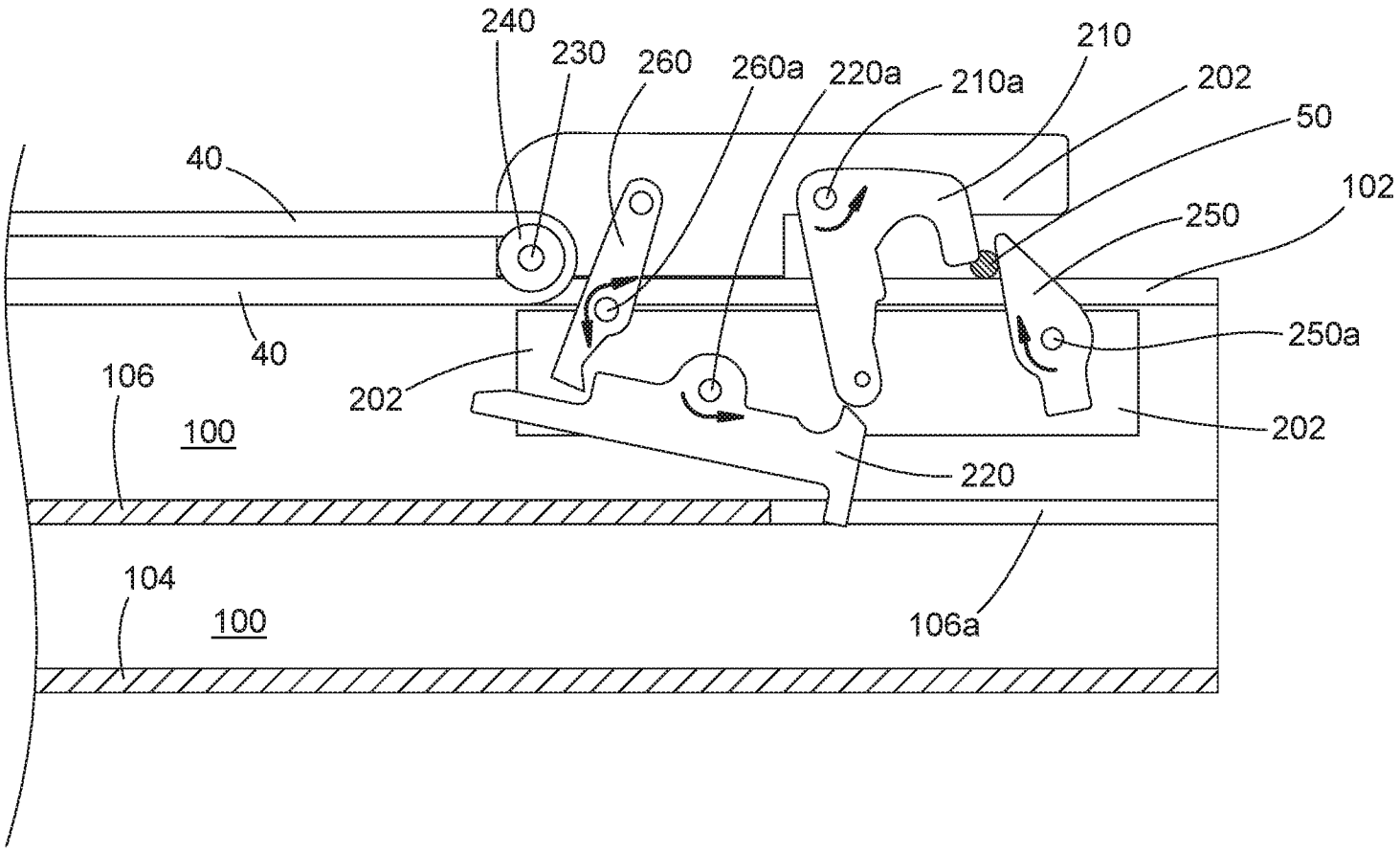
FIG. 6B PRIOR ART
Figure 6C:
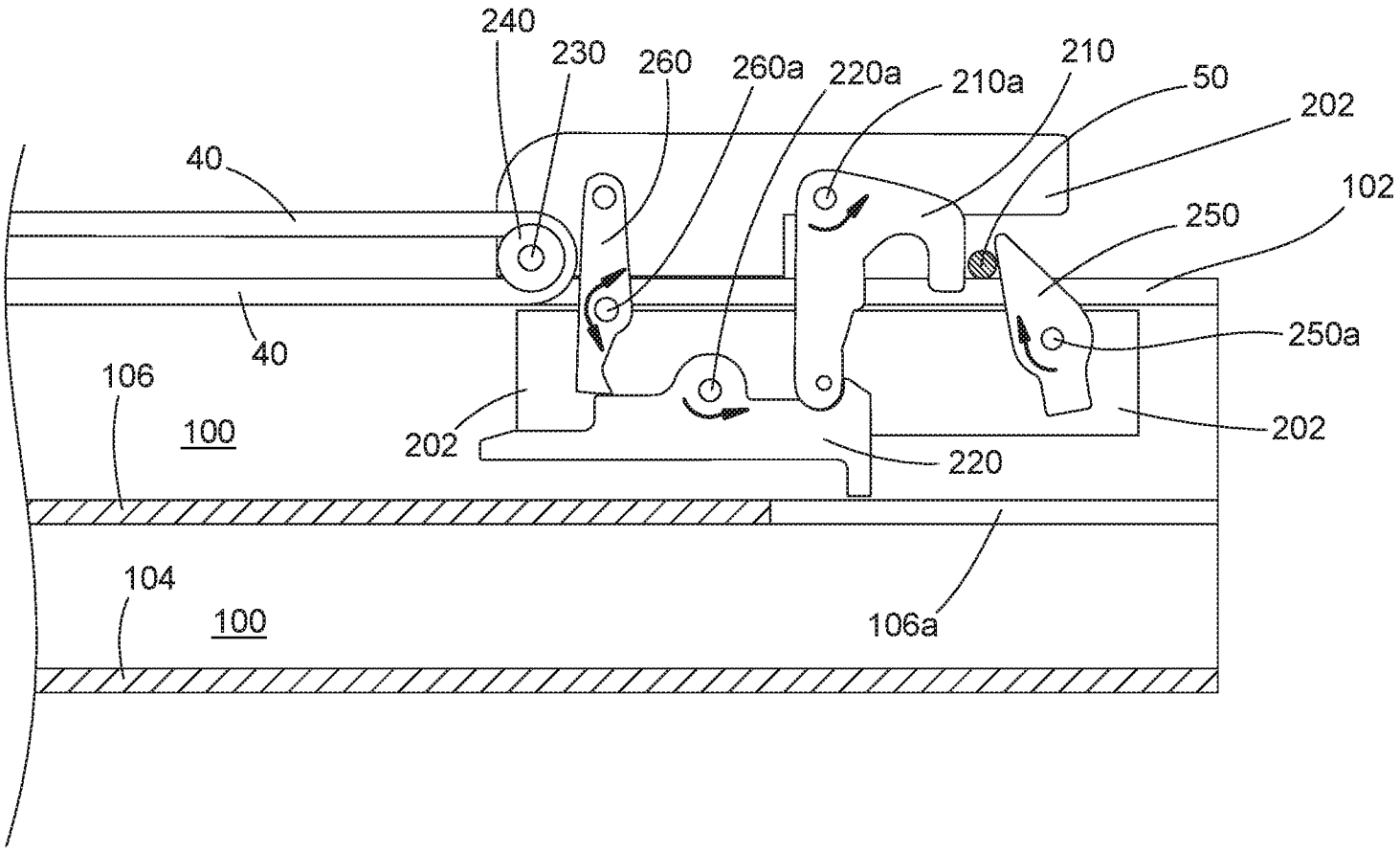
FIG. 6C PRIOR ART
Figure 6D:
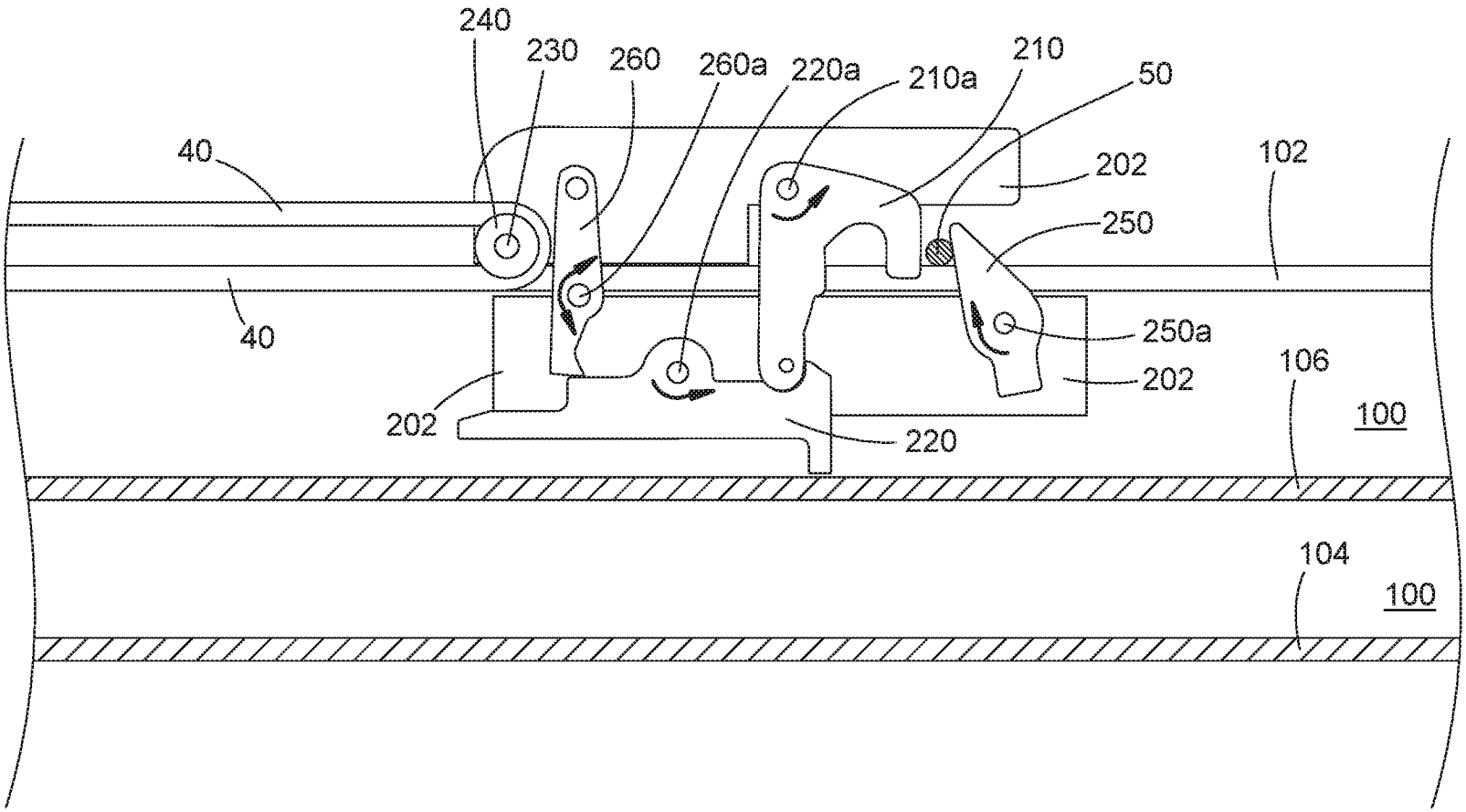
FIG. 6D PRIOR ART
Figure 6E:
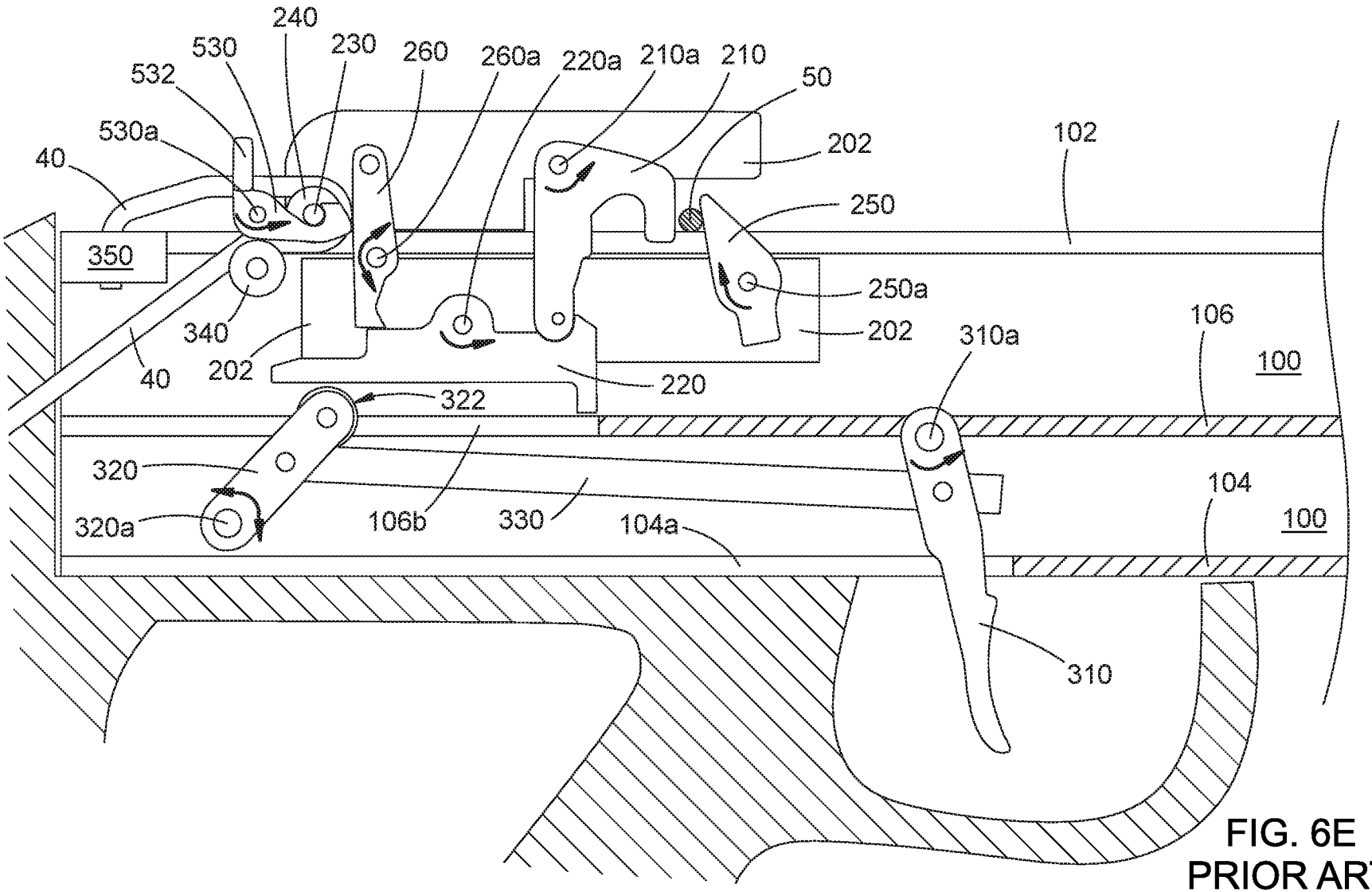
FIG. 6E PRIOR ART
Figure 6F:
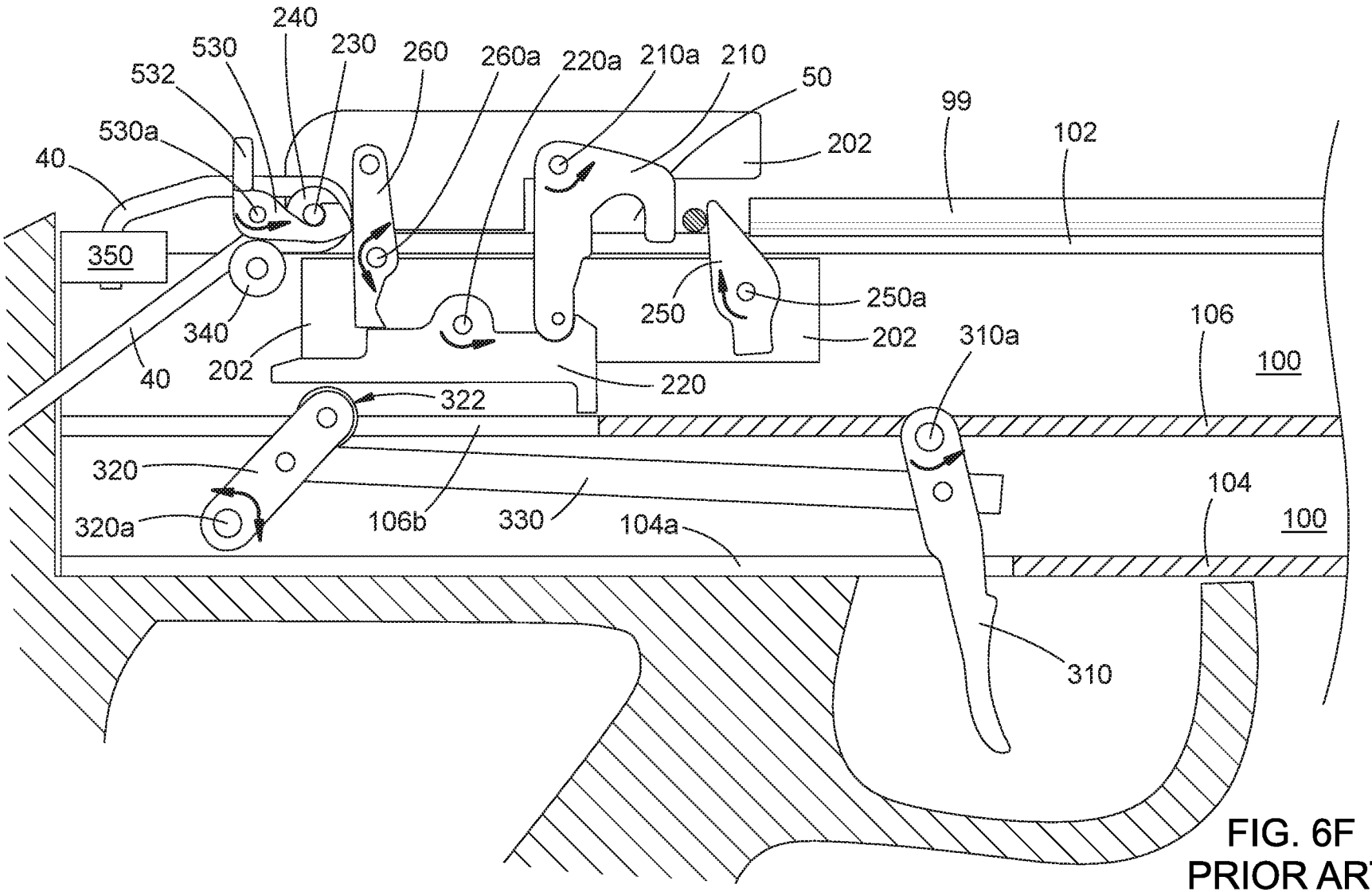
FIG. 6F PRIOR ART
Figure 6G:
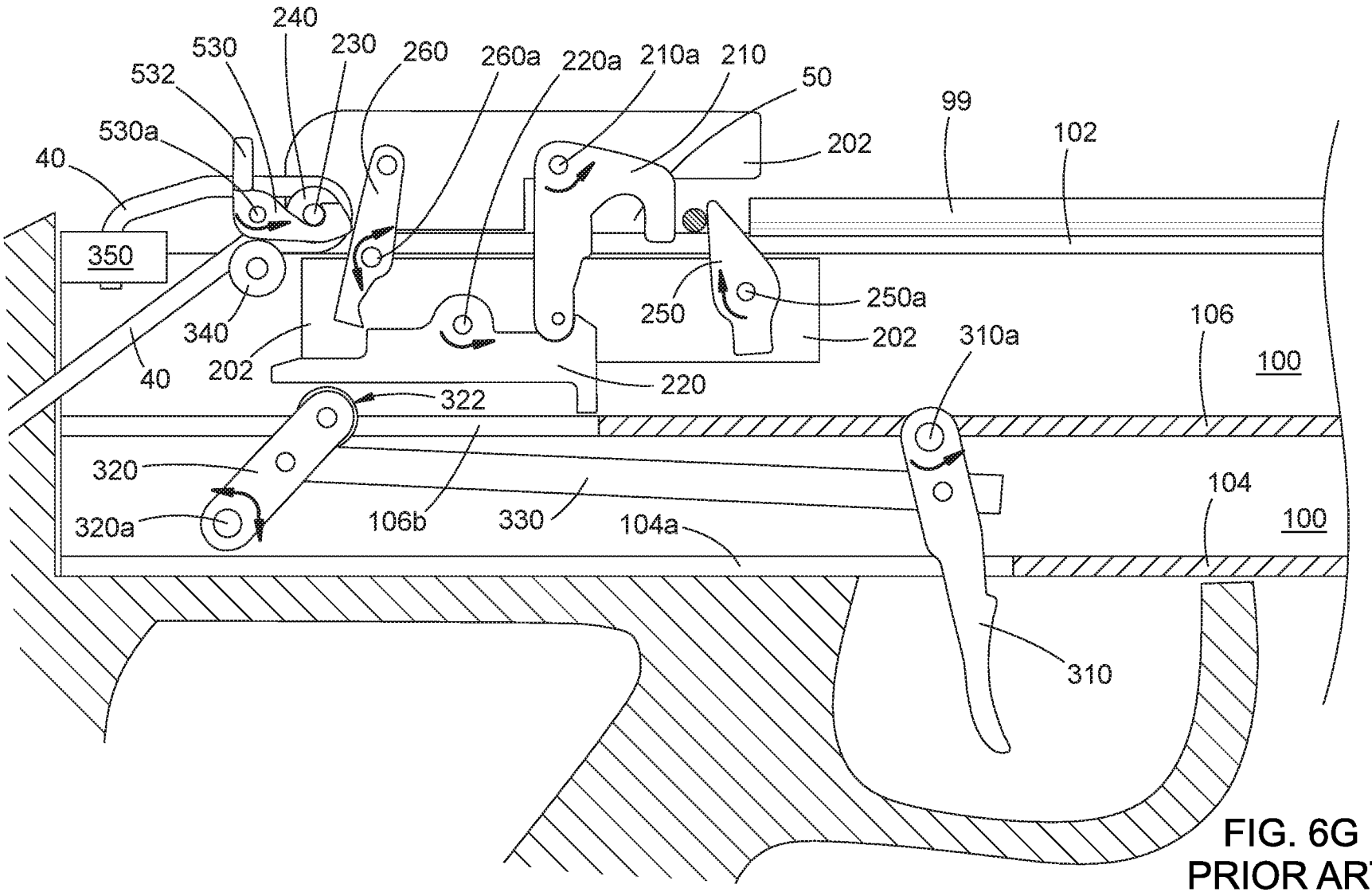
FIG. 6G PRIOR ART
Figure 6H:
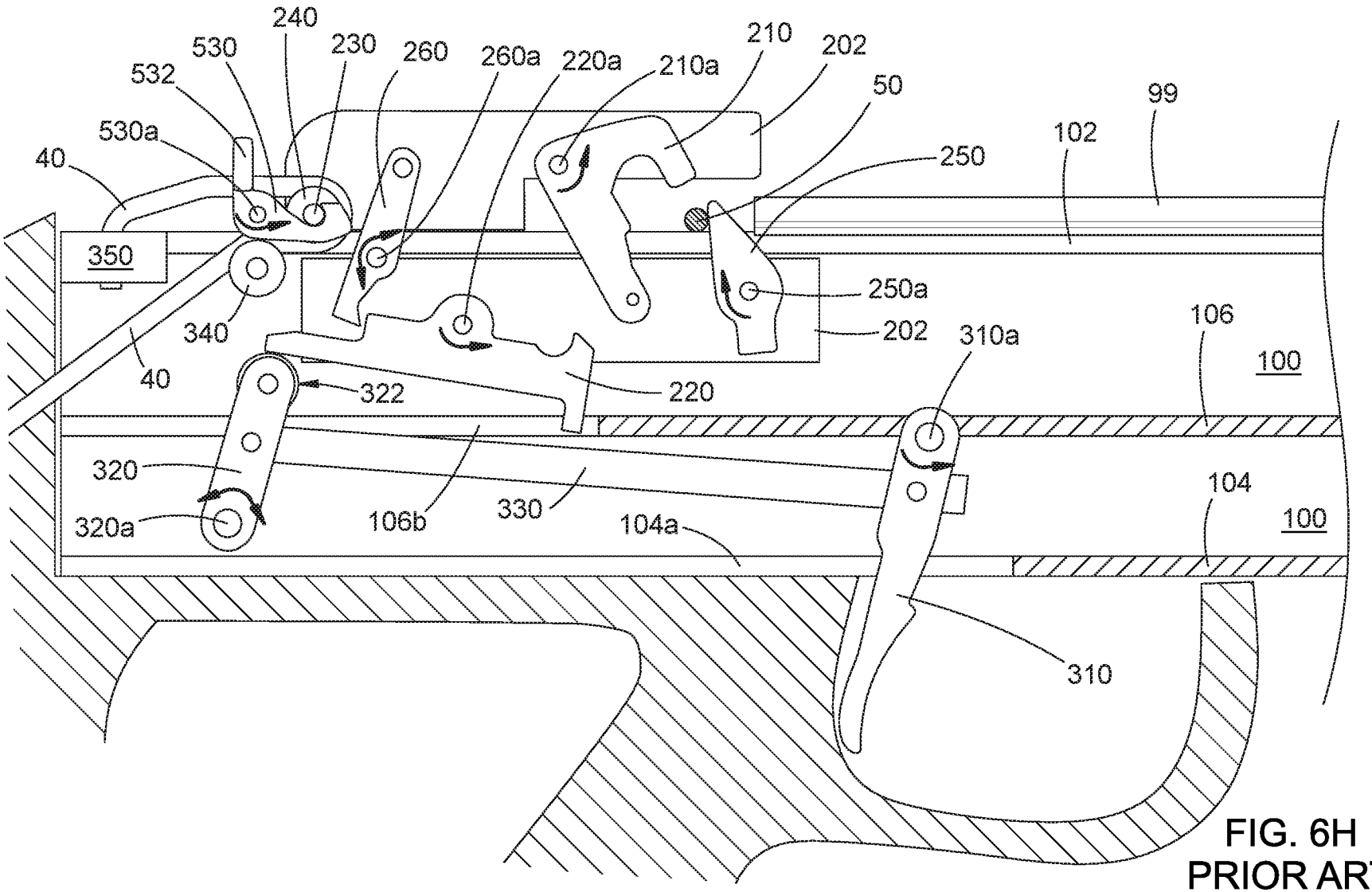
FIG. 6H PRIOR ART
Figure 6I:
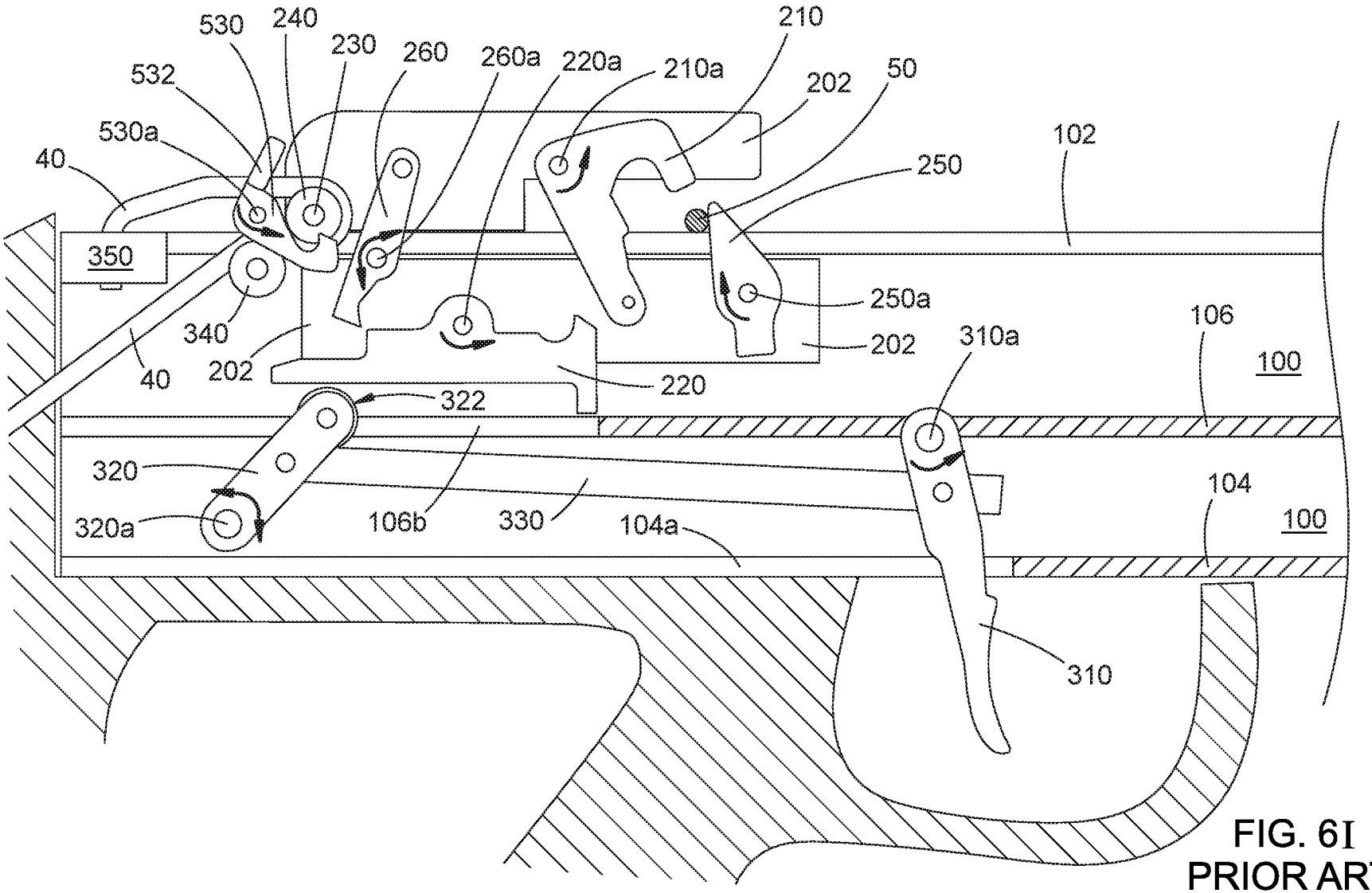
FIG. 6I PRIOR ART

For purposes of the present disclosure and appended claims, when a part, member, subassembly, or other element is described as movable "between" a first position and a second position, the element in questions can assume the first position, can move from the first position to the second position, can assume the second position, and can move from the second position to the first position. The term "intermediate" is intended to designate positions excluding the first and second positions. For example, FIGS. 4D and 6D each show the movable trigger subassembly 200 at an intermediate position along the mainframe 100. Any bias force described can be provided using any suitable element, mechanism, or arrangement, such as springs (compression, extension, torsion), weights, levers, magnets, and so forth.

Figure 3:
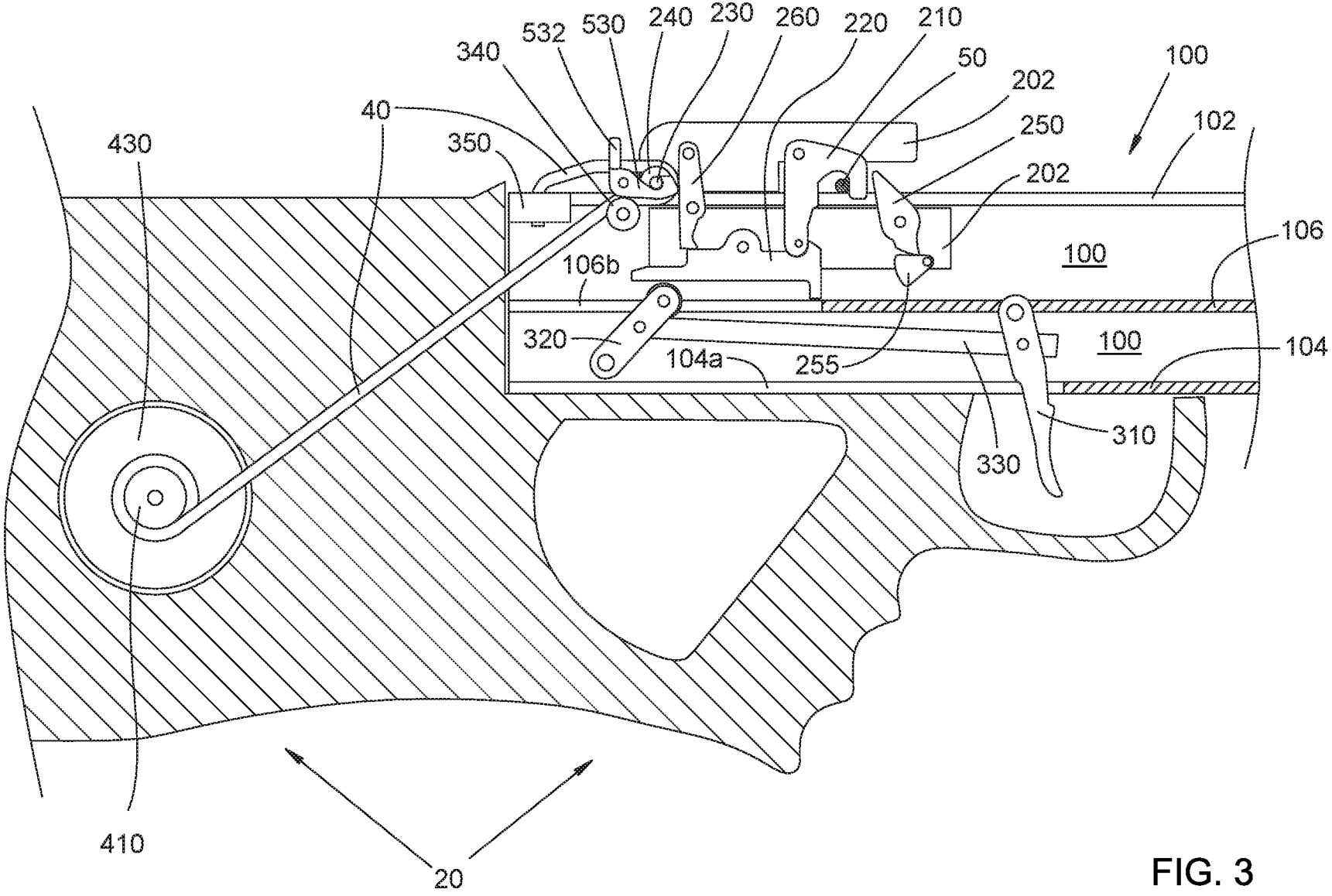
FIG. 3 is a schematic, partially cross sectional, side view of an inventive anti-dry-fire mechanism for the crossbow, with the crossbow at full draw.

A schematic, partially cross sectional, side view of a trigger including an inventive anti-dry-fire mechanism is illustrated schematically if FIG. 3 to give an overview of the inventive mechanism; FIGS. 4A-4I are similar, enlarged views illustrating a sequence of arrangements that arise in the course of properly using the crossbow 10 that includes the inventive anti-dry-fire mechanism. FIGS. 5 and 6A-6I are analogous views of a trigger mechanism including a conventional anti-dry-fire mechanism (used improperly; discussed further below). Although the entirety of the stock subassembly 20 is shown with continuous cross hatching in the drawings, the stock subassembly 20 typically would include multiple parts and various internal spaces or workings. Those have been mostly omitted from the drawings for clarity, but a crossbow mechanism or crossbow including such parts, spaces, or workings shall nevertheless fall within the scope of the present disclosure or appended claims.

The stationary trigger subassembly 300 is mounted on a rearward portion of the mainframe 100; the movable trigger subassembly 200 is engaged with the slot 102 of the mainframe 100 so as to be movable along the mainframe 100 between a forward brace position (e.g., as in FIGS. 1, 4B, 4C, 6B, and 6C) and a rearward drawn position (e.g., as in FIGS. 2, 3, 4E-4I, 5, and 6E-6I). The movable trigger subassembly 200 comprises a body 202 engaged with the slot 102 of the mainframe 100, a bowstring catch 210, and a sear 220. The stationary trigger subassembly 300 comprises a trigger 310 and an actuator 320. With the movable trigger subassembly 200 in the drawn position and a bowstring 50 of the crossbow 10 retained by the bowstring catch 210 (e.g., as in FIGS. 4E-4G), the trigger 310, the actuator 320, the sear 220, and the bowstring catch 210 are arranged so that (i) movement of the trigger 310 (e.g., rotation about axis 310*a* in the example shown) causes movement of the actuator 320 (e.g., rotation about axis 320*a* in the example shown), (ii) movement of the actuator 320 causes movement of the sear 220 (e.g., rotation about axis 220*a* in the example shown), (iii) movement of the sear 220 permits movement of the bowstring catch 210 (e.g., rotation about axis 210*a* in the example shown), and (iv) movement of the bowstring catch 210 releases the bowstring 50. Those movements result in the arrangement of, e.g., FIG. 4H.

The bowstring catch 210 is movable between a firing catch position (e.g., as in FIGS. 4A, 4H, and 4I) and a non-firing catch position (e.g., as in FIGS. 3 and 4C-4G); the bowstring catch 210 is biased (directly, in any suitable way) toward the firing catch position. In the example shown, the bowstring catch 210 rotates about a pivot axis 210*a*. The bowstring catch 210 can be arranged in any suitable way; a common arrangement is as a so-called caliper, with a pair of laterally spaced-apart prongs that retain the bowstring and straddle a bolt 99 loaded onto the crossbow 10. With the bowstring catch 210 in the non-firing catch position, the bowstring catch 210 retains the bowstring 50; with the bowstring catch 210 in the firing catch position, the bowstring catch 210 releases the bowstring 50. The sear 220 is movable between a firing sear position (e.g., as in FIG. 4H) and a non-firing sear position (e.g., as in FIGS. 3 and 4C-4G); the sear 220 is biased (directly, in any suitable way) toward the non-firing sear position. In the example shown, the sear 220 rotates about a pivot axis 220*a*. With the sear 220 in the non-firing sear position, the sear 220 obstructs movement of the bowstring catch 210 away from the non-firing catch position; with the sear 220 in the firing sear position, the sear 220 permits movement of the bowstring catch 210 to the firing catch position, in response to bias on the bowstring catch 210, thereby causing release of the bowstring 50. In some examples, the bowstring catch 210 includes a roller that engages the sear 220 and facilitates movement of the bowstring catch 210 past the sear 220 when the crossbow is fired (e.g., in making the transition from FIG. 4G to FIG. 4H). Such a roller can also facilitate movement of the bowstring catch 210 past the sear 220 when the bowstring catch 210 is moved into the non-firing catch position with the movable trigger subassembly is at the brace position (e.g., as in FIG. 4B). That motion enable the bowstring to be retained by the bowstring catch 210 in preparation for drawing the crossbow 10.

The trigger 310 is movable between a firing trigger position (e.g., as in FIG. 4H) and a non-firing trigger position (e.g., as in FIGS. 3, 4E-4G, and 4I); the trigger 310 is biased (directly, in any suitable way) toward the non-firing trigger position. In the example shown, the trigger 310 rotates about a pivot axis 310*a*. In a common arrangement, the trigger extends downward through a slot 104*a* through the bottom surface 104 of the mainframe 100. The actuator 320 is coupled to the trigger 310 and movable between a firing actuator position (e.g., as in FIG. 4H) and a non-firing actuator position (e.g., as in FIGS. 3, 4E-4G, and 4I). Movement of the trigger 310 to the firing trigger position, against the bias on the trigger 310, causes movement of the actuator 320 to the firing actuator position. With the movable trigger subassembly 200 in the drawn position, movement of the actuator 320 to the firing actuator position causes movement, against bias on the sear 220, of the sear 220 to the firing sear position. In the example shown, the trigger 310 and the actuator 320 are coupled by the linkage 330; that is only one of myriad arrangements that can be employed within the scope of the present disclosure or appended claims. In other examples, discrete trigger 310 and actuator 320 can be coupled directly, without the linkage 330. In still other examples, the trigger 310 and actuator 320 can comprise a single, rigid structure. In some examples, the actuator 320 includes a roller 322 that engages the sear 220. In some examples, the trigger 310 and the actuator 320 are arranged so that, with the movable trigger subassembly 200 in the drawn position and the trigger 310 held in the non-firing position by the bias on the trigger 310, the actuator 320 does not make contact with the sear 220 (e.g. as in FIGS. 3, 4E-4G, and 4I). With the movable trigger subassembly 200 in the drawn position, movement of the trigger 310 from the non-firing trigger position to the firing trigger position first causes the actuator 320 to make contact with the sear 220 and then causes the actuator 320 to move the sear 220 to the firing sear position (e.g., as in FIG. 4H). The lack of contact facilitates movement of the movable trigger subassembly 200 rearward to the drawn position without interference between the actuator 320 and the sear 220.

Dry-firing the crossbow 10 (i.e., firing the drawn crossbow 10 without a bolt 99 loaded) is a safety hazard. To reduce the likelihood of a dry-fire, the movable trigger subassembly 200 includes a bowstring latch 250. The bowstring latch is movable between a bolt-present position (e.g., as in FIGS. 4B, 4C, 4F, and 4G) and a bolt-absent position (e.g., as in FIGS. 3, 4A, 4D, 4E, 4H, and 4I). In the example shown, the bowstring latch 250 rotates about a pivot axis 250*a*. The bowstring latch 250 is biased (directly, in any suitable way) toward the bolt-absent position. With the bowstring latch 250 in the bolt-absent position, the bowstring latch 250 obstructs forward movement of the bowstring 50 past the bowstring latch 250 (i.e., from a position rearward of the bowstring latch 250 to a position forward of the bowstring latch 250); with the bowstring latch 250 in the bolt-present position, the bowstring latch 250 does not obstruct forward movement of the bowstring 50 past the bowstring latch 250. With the bowstring catch 210 in the non-firing catch position retaining the bowstring 50, the movable trigger subassembly 200 in the drawn position, and a bolt 99 loaded onto the mainframe 100 and positioned over the bowstring latch 250 (in some instances with a nock against the bowstring 50 or against the bowstring catch 210), the bolt 99 holds the bowstring latch 250 in the bolt-present position against the bias on the bowstring latch 250. With no bolt 99 loaded onto the mainframe 100, the bowstring latch 250 is held in the bolt-absent position by the bias on the bowstring latch 250.

FIGS. 5 and 6A-6I illustrate improper use of a crossbow with a trigger assembly that includes a conventional anti-dry-fire mechanism. As the movable trigger subassembly 200 approaches the brace position in preparation for the next shot, the bowstring latch 250 is held in its bolt-absent position by its bias (as in FIG. 6A). As the movable trigger subassembly 200 reaches the brace position, or with the movable trigger subassembly 200 in the brace position, the bowstring 50 is forced over the bowstring latch 250 (briefly forcing it against it bias toward or into the bolt-present position before returning to the bolt-absent position (as in FIG. 6B). When properly used, the bowstring 50 is pulled back further to engage the bowstring catch 210, forcing it into the catch non-firing position with the bowstring 50 retained by the bowstring catch 210; drawing the crossbow 10 with the bowstring 50 thus engaged results in the arrangement of FIG. 5, and the crossbow is ready to fire after loading a bolt 99 and releasing the safety 260. However, in some instances the user of the crossbow 10 does not properly engage the bowstring 50 with the bowstring catch 210, and proceeds to draw the crossbow 10 with the bowstring 50 held by only the bowstring latch 250 (as in FIGS. 6C and 6D) until the movable trigger subassembly reaches the drawn position (as in FIG. 6E). The bolt 99 loaded onto the slot 102 is blocked by the bowstring latch 250 (as in FIG. 6F; often obscured from the user's view by a sight mount or other hardware mounted on the crossbow 10; shown only in FIGS. 1 and 2). After releasing the safety 260, pulling the trigger 310 causes the bowstring catch 210 to move to its firing position (as in FIG. 6G), but the bowstring 50 is not released because it is retained by the bowstring latch 250 in its bolt-absent position (despite the presence of the bolt 99). Often it is only upon pulling the trigger 310 and observing that the bolt 99 is not launched that the user becomes aware of his or her mistake. This undesirable state of affairs can only be remedied by removing the bolt 99, disengaging the trigger latch 530 (if present), and moving the moveable trigger subassembly 200 to the brace position to return the crossbow 10 to its undrawn state. If present, a winch mechanism (e.g., winch subassembly 400; discussed further below) can facilitate safe return to the undrawn state, which otherwise can be difficult or hazardous.

The inventive anti-dry-fire mechanism is arranged to prevent the mistake described above. Accordingly, the inventive anti-dry-fire mechanism includes arrangement of the mainframe 100 and the bowstring latch 250 so that, with the movable trigger subassembly in the brace position (as in FIGS. 4B and 4C), direct or indirect engagement of the mainframe 100 with the bowstring latch 250 holds the bowstring latch 250 in the bolt-present position (without a bolt 99 present) against the bias on the bowstring latch 250. With the bowstring latch 250 held in the bolt-present position (despite no bolt 99 being present), the bowstring 50 can be readily moved backward past the bowstring latch 250 to engage and be retained by the bowstring catch 210 (as in FIGS. 4B and 4C). There is no chance for drawing the crossbow with the bowstring 50 retained by only the bowstring latch 250, because in its bolt-present position it cannot retain the bowstring 50. The user would be immediately aware of the lack of retention of the bowstring 50 by the bowstring catch 210 and could correct that lack of retention before continuing to draw the crossbow 10.

The bowstring latch 250 can be of any suitable size, shape, or arrangement. In some examples, the bowstring latch 250 can move between the engaged and non-engaged positions by rotation (about pivot axis 250*a* in the example shown); in some examples the bowstring latch 250 can move between the engaged and non-engaged positions by curvilinear movement (i.e., by translation). The mainframe 100 can include at least one engagement surface arranged for engaging the bowstring latch 250, as the movable trigger subassembly 200 moves to the brace position, and for forcing movement of the bowstring latch 250 to the bolt-present position against its bias. The upper surface of the mainframe engagement member 108 serves as such an engagement surface in the example shown; any other suitable arrangement can be employed. In some examples at least one engagement surface of the mainframe 100 can include at least one curved, sloped, inclined, or beveled engagement surface.

In some examples, direct engagement of the mainframe 100 and the bowstring latch 250 holds the bowstring latch 250 in the bolt-present position against its bias (with the movable trigger subassembly 200 in the brace position). In some other examples (including the one shown), indirect engagement of the mainframe 100 with the bowstring latch 250 holds the bowstring latch 250 in the bolt-present position against its bias (with the movable trigger subassembly 200 in the brace position).

In some examples (including the example shown in FIGS. 3 and 4A-4I), the movable trigger subassembly 200 can include a latch lever 255 movable between an engaged position and a non-engaged position. In some examples, the latch lever 255 can move between the engaged and non-engaged positions by rotation (about pivot axis 255*a* in the example shown); in some examples the latch lever 255 can move between the engaged and non-engaged positions by curvilinear movement (i.e., by translation). With the latch lever 255 in the non-engaged position, the latch lever 255 permits the bowstring latch 250 to move to the bolt-absent position (as in FIGS. 4A, and 4D, 4E, 4H, and 4I; note that in FIGS. 4F and 4G the bowstring latch 250 is held in its bolt-present position by the bolt 99, not by engagement of the latch lever 255). With the latch lever 255 held in the engaged position by engagement with the mainframe 100 (as in FIGS. 4B and 4C), the latch lever 255 holds the bowstring latch 250 in the bolt-present position against its bias. With the movable trigger subassembly 200 in an intermediate position (as it moves toward the brace position for the next shot as in FIG. 4A, or as it moves toward the drawn position as the crossbow 10 is drawn as in FIG. 4D) or in the drawn position with no bolt 99 present (as in FIGS. 4E, 4H, and 4I), the latch lever 255 is in the non-engaged position and the bowstring latch 250 is in the bolt-absent position. With the movable trigger subassembly 200 in the drawn position with a bolt 99 present (as in FIGS. 4F and 4G), the latch lever 255 permits movement of the bowstring latch 250 to the bolt-present position against its bias. With the movable trigger subassembly 200 in the brace position (as in FIGS. 4B and 4C), engagement of the latch lever 255 with the mainframe 100 holds the latch lever 255 in the engaged position, thereby indirectly engaging the mainframe 100 with the bowstring latch 250 and holding the bowstring latch 250 in the bolt-present position against its bias. The latch lever 255 can include at least one engagement surface that engages the mainframe 100, as the movable trigger subassembly 200 moves to the brace position, and forces movement of the bowstring latch 250 to the bolt-present position against its bias; such an engagement surface of the latch lever 255 can include at least one curved, sloped, inclined, or beveled engagement surface. In the example shown the lower surface of the latch lever 255 engages the top surface of the mainframe engagement member 108 when the movable trigger subassembly 200 is in the brace position (as in FIGS. 4B and 4C).

In some examples (including the example shown), the latch lever is biased toward the engaged position; that bias serves to keep the latch lever 255 out of the way and avoid interference with other crossbow components as the crossbow 10 is drawn, fired, and returned to brace for the next shot. However, such a bias on the latch lever 255 (if any) should be insufficient to move the bowstring latch 250 to the bolt-present position against the bias on the bowstring latch 250.

Unintentional firing of the crossbow 10 is also a significant safety concern. To reduce the likelihood of unintentional firing of the crossbow 10, the movable trigger subassembly can include a safety member 260 that is movable by a user of the crossbow 10 between a safety-on position (e.g., as in FIGS. 3, and 4C-4F), and a safety-off position (e.g., as in FIGS. 4A, 4B, and 4G-4I). In some examples, the safety member 260 is not biased to move in either direction; in some examples, the safety member 260 can be biased so as to move automatically to the safety-on position in the absence of action by the user. In some examples the movable trigger subassembly 200 can be arranged so that the safety member 260 can be retained in the safety-on position, in the safety-off position, or both, by a suitably arranged detent mechanism (e.g., so as to enable movement of the safety member 260 in response to action of the user, but to inhibit accidental or unintentional movement of the safety member 260). In the example shown, the safety member 260 rotates about a pivot axis 260*a* and is not biased to rotate in either direction. With the safety member 260 in the safety-on position, the safety member 260 obstructs movement of the sear 220 from the non-firing sear position; with the safety member 260 in the safety-off position, the safety member 260 does not obstruct movement of the sear 220 to the firing sear position. In the example shown, a pair of safety knobs are attached to the safety member 260 and protrude to enable the user to move the safety member 260 to the desired position.

It may be desirable to wholly preclude firing of the crossbow 10 under certain conditions. For example, it may be desirable to prevent firing, even with the safety member 260 in the safety-off position, when the movable trigger subassembly 200 is at an intermediate position along the mainframe 100 (e.g., during drawing or decocking the crossbow). In some examples, the sear 220 and the mainframe 100 are arranged so that, with the movable trigger subassembly 200 at intermediate positions along the mainframe 100, the mainframe 100 obstructs movement of the sear 220 to the firing sear position. With the movable trigger subassembly 200 in the brace position or the drawn position, the mainframe 100 does not obstruct movement of the sear 220 to the firing sear position, thereby permitting movement of the bowstring catch 210 between the non-firing catch position and the firing catch position. In the example shown, the mainframe 100 includes a horizontal interior partition 106. With the movable trigger subassembly 200 at an intermediate position along the mainframe 100, the interior partition 106 obstructs movement of the sear 220 to the firing sear position (e.g., as in FIG. 4D). The sear 220 cannot move even if the safety member 260 is in the safety-off position. The interior partition 106 has a forward slot 106*a* and a rearward slot 106*b*. The forward slot 106*a* permits movement of the sear 220 to the firing sear position with the movable trigger subassembly 200 at the brace position (if the safety member 260 is in the safety-off position; e.g., as in FIG. 4B). That movement at that position enables the bowstring catch 210 to be moved, against its bias, to the non-firing catch position to capture the bowstring 50 for drawing the crossbow 10. If the sear 220 could not move toward the firing sear position, the bowstring catch 210 could not be moved to the non-firing catch position. The rearward slot 106*b* permits movement of the sear 220 to the firing sear position (if the safety member 260 is in the safety-off position; e.g., as in FIG. 4H). That movement at that position enables the crossbow 10 to be fired.

In some examples the crossbow 10 is drawn manually, by pulling on the bowstring 50 with one's hands or with a handle, rope, or other cocking aid. In some examples a winch subassembly 400 can be mounted in the stock subassembly 20. The winch subassembly 400 can include a spool 410, a crank handle coupled to rotate the spool 410, and a rope 40 coupled to the movable trigger subassembly 200. Rotation of the spool 410 to take up the rope 40 causes rearward movement of the movable trigger subassembly 200 along the mainframe 100 in response to tension on the rope 40. Rotation of the spool 410 to let out the rope 40 permits forward movement of the movable trigger subassembly 200 along the mainframe. In many examples the crank handle can be detachable from the spool 410. Note that the winch subassembly 400 generally, and the spool 410 in particular, typically are not directly biased (e.g., by a spring or other biasing element) to rotate in one direction versus the other. However, tension on the bowstring 50 during drawing of the crossbow 10 and while holding the bowstring 50 at full draw will tend to pull the movable trigger subassembly 200 forward, and the resulting tension on the rope 40 will tend to rotate the spool 410 to let out the rope 40. The winch subassembly 400 can therefore include a clutch 430, of any suitable type, to prevent unwanted let-out of the rope 40 from the spool 410 in response to tension on the rope 40 (arising from tension on the bowstring 50 retained by the bowstring catch 210). The clutch 430 allows free rotation of the spool 410 to take up the rope 40 and the hand crank is turned to draw the crossbow 10. Suitable examples of the clutch 430 include a sprag clutch, a ratchet-and-pawl-type clutch, or other suitable freewheel clutch.

To prepare for the next shot after firing the crossbow 10, or if it desired to decock the crossbow 10 without firing, the movable trigger subassembly 200 must be moved forward to the brace position. In some examples, that forward motion requires operation of the hand crank to let out the rope 40 from the spool 410 in a controlled manner, despite tension on the bowstring 50 and the rope 40. In examples that include a clutch, the clutch 430 can be arranged to allow disengagement of the clutch 430 and free rotation of the spool 410 to let out the rope 40; typically the hand crank would be employed in conjunction with disengagement of the clutch 430, to control movement of the movable trigger subassembly 200 under tension from the bowstring 50. Any suitable arrangement can be employed to enable engagement and disengagement of the clutch 430. In some examples, the clutch 430 is biased toward engagement, and therefore requires the user to apply a force or torque to manually disengage the clutch 430 when needed or desired.

In some examples the rope 40 is simply attached directly to the movable trigger subassembly 200. Any suitable attachment can be employed, such as a clamp, loop, or anchor. In the case of a simple, direct attachment, force exerted by the rope 40 on the movable trigger subassembly 200, as the crossbow is drawn, is about equal to the tension on the rope 40 (neglecting effects of friction or misalignment). In other examples, including the example shown in the drawings, the movable trigger subassembly 200 includes a pulley 240 which rotates about the pulley axle 230. The rope 40 is looped around the pulley 240 and connected directly to the stationary trigger subassembly 300 or the stock subassembly 20 (e.g., rope anchor 350 in the example shown in the drawings). In such a so-called block-and-tackle arrangement, force exerted on the movable trigger subassembly 200, as the bow is drawn, is about equal to two times the tension on the rope 40 (again, neglecting effects of friction or misalignment). The pulley 340 redirects the rope 40 between the spool 410 and the movable trigger subassembly 200 so that the force applied is substantially parallel to the direction of movement of the movable trigger subassembly 200. In the example shown, the pulley axle 230 doubles as the engagement point on the movable trigger subassembly for the trigger latch 530 (discussed below). That is a convenient arrangement, but need not be the case. In other examples, structural elements for engaging the trigger latch 530 can be distinct from the pulley 240 and its axle 230.

It may be desirable to hold the crossbow 10 at full draw without relying on tension on the rope 40. It would be desirable to enable use of the crossbow 10 even if the rope 40 were to break or otherwise become unusable, or if the crossbow 10 is intended to be manually drawn and therefore lacks a winch subassembly entirely. To that end, one or both of the movable or stationary trigger subassemblies 200/300 can include a trigger latch 530. The trigger latch 530 is movable between a latched position (e.g., as in FIGS. 3 and 4E-4H) and an unlatched position (e.g., as in FIG. 4I). In many examples, the trigger latch 530 is biased (directly, in any suitable way) toward the latched position. In the example shown, the trigger latch rotates about a pivot axis 530*a* between the latched and unlatched positions. In the latched position and with the movable trigger subassembly 200 in the drawn position, the trigger latch 530 obstructs movement of the movable trigger subassembly 200 from the drawn position in the forward direction. In the example shown, the trigger latch 530 is mounted on the stationary trigger subassembly 300 and engages the pulley axle 230 on the movable trigger subassembly 200; that is only one of myriad arrangements that can be employed within the scope of the present disclosure or appended claims, with the trigger latch 530 being mounted on either of the movable or stationary subassemblies 200/300 and engaging a structural element of the other subassembly. Whatever the details of its arrangement, the trigger latch 530 holds the movable trigger subassembly 200 in place at the drawn position without relying on tension on the rope 40. In the unlatched position, the trigger latch 530 permits movement of the movable trigger subassembly 200 from the drawn position in the forward direction, e.g., after firing the crossbow 10 to prepare to draw the bowstring 50 for the next shot. If the rope 40 were broken or otherwise unusable, the crossbow 10 could still be used by using the trigger latch 530 to "park" the movable trigger subassembly at its drawn position and hold it there. In that event, alternate means would be needed for drawing the bowstring 50 in place of using the winch subassembly 400.

In many examples, the trigger latch 530 is arranged to be moved manually by a user of the crossbow to the unlatched position, against the bias on the trigger latch 530, to permit forward movement of the movable trigger subassembly 200 from the drawn position in the forward direction (e.g., to prepare for the next shot). In the example shown, the trigger latch 530 includes a lever 532 that protrudes from the stationary trigger subassembly 300 so as to be accessible to the user.

In some examples, the trigger latch 530 is arranged so that rearward movement of the movable trigger subassembly 200 to the drawn position automatically engages the trigger latch 530 with the movable trigger subassembly 200. That rearward movement first causes movement of the trigger latch 530 toward the unlatched position against the bias on the trigger latch. Further rearward movement then permits the trigger latch 530 to move to the latched position in response to the bias on the trigger latch 530, where it then obstructs forward movement of the movable trigger subassembly 200 from the drawn position. In the example shown, a front portion of the trigger latch 530 has a beveled surface. As the movable trigger subassembly 200 move rearward, the pulley axle 230 makes contact with the beveled surface, which then pushes the trigger latch 530 toward the unlatched position. Upon sufficient rearward movement, the trigger latch 530 is able to snap back to the latched position, in response to the bias, and engage the axle 230 to hold the movable trigger subassembly 200 in the drawn position.

A method for using the crossbow 10 comprises: (A) with the movable trigger subassembly 200 in the brace position, moving the bowstring catch 210 to the non-firing catch position to retain the bowstring 50 (e.g., as in FIGS. 4B and 4C; with the winch subassembly 400, if present); (B) moving the movable trigger subassembly 200 to the drawn position against tension on the bowstring 40, thus drawing the crossbow 10 (e.g. as in FIGS. 4D and 4E); (C) holding the movable trigger subassembly 200 in the drawn position against the tension on the bowstring 50 (e.g., as in FIGS. 4E-4G, with the trigger latch 530, if present); (D) placing a bolt 99 on the slot 102 over the bowstring latch 250, forcing the bowstring latch 250 into the bolt-present position (e.g., as in FIGS. 4F and 4G); and (E) moving the trigger 310 to the firing trigger position, thereby moving the actuator 320 to the firing actuator position, moving the sear 220 to the firing sear position, permitting the bowstring catch 210 to move to the firing catch position, releasing the bowstring 50, and firing the crossbow 10 to launch the bolt 99 (e.g., as in FIG. 4H). The method for using the crossbow 10 can further comprise, after firing the crossbow 10: (F) moving the movable trigger subassembly 200 to the brace position (e.g., as in FIG. 4A, in preparation for repeating FIGS. 4B and 4C). If the crossbow 10 includes a safety, the method can further include: after part (A) and before part (B), moving the safety member to the safety-on position (e.g. as in FIG. 4C); and after part (D) and before part (E), moving the safety member to the safety-off position (e.g., as in FIG. 4F).

In addition to the preceding, the following examples fall within the scope of the present disclosure or appended claims:

Example 1. An anti-dry-fire mechanism for a crossbow, the mechanism comprising (i) an elongated mainframe of the crossbow, the mainframe having a longitudinal slot, and (ii) a movable trigger subassembly of the crossbow, wherein: (a) the movable trigger subassembly includes a body engaged with the slot of the mainframe, a bowstring catch, and a bowstring latch, and engagement of the body with the slot of the mainframe enables bidirectional movement of the movable trigger subassembly along the mainframe between a forward brace position and a rearward drawn position; (b) the bowstring catch is movable between a firing catch position and a non-firing catch position and arranged so that (i) with the bowstring catch in the non-firing catch position, the bowstring catch is arranged to retain a bowstring of the crossbow, and (ii) with the bowstring catch in the firing catch position, the bowstring catch is arranged to release the bowstring; (c) the bowstring latch is positioned forward of the bowstring catch, movable between a bolt-present position and a bolt-absent position, biased toward the bolt-absent position, and arranged so that (i) with the bowstring latch in the bolt-absent position, the bowstring latch obstructs forward movement of the bowstring past the bowstring latch, (ii) with the bowstring latch in the bolt-present position, the bowstring latch does not obstruct forward movement of the bowstring past the bowstring latch, (iii) with the movable trigger subassembly in the drawn position and a bolt loaded onto the mainframe and positioned over the bowstring latch, the bolt holds the bowstring latch in the bolt-present position against bias on the bowstring latch, and (iv) with the movable trigger subassembly in the drawn position and no bolt loaded onto the mainframe, the bowstring latch is held in the bolt-absent position by the bias on the bowstring latch; and (d) the mainframe and the bowstring latch are arranged so that, with the movable trigger subassembly in the brace position, direct or indirect engagement of the mainframe with the bowstring latch holds the bowstring latch in the bolt-present position against the bias on the bowstring latch.

Example 2. The anti-dry-fire mechanism of Example 1 wherein the mainframe includes at least one engagement surface arranged for engaging the bowstring latch, as the movable trigger subassembly moves to the brace position, and forcing movement of the bowstring latch to the bolt-present position against the bias on the bowstring latch.

Example 3. The anti-dry-fire mechanism of Example 2 wherein the at least one engagement surface of the mainframe includes at least one curved, sloped, inclined, or beveled engagement surface.

Example 4. The anti-dry-fire mechanism of any one of Examples 1 through 3 wherein (i) the movable trigger subassembly includes a latch lever movable between an engaged position and a non-engaged position, (ii) with the latch lever in the non-engaged position, the latch lever permits the bowstring latch to move to the bolt-absent position, (iii) with the latch lever held in the engaged position by engagement with the mainframe, the latch lever holds the bowstring latch in the bolt-present position against the bias on the bowstring latch, and (iv) the mainframe and the latch lever are arranged so that, with the movable trigger subassembly in the brace position, engagement of the latch lever with the mainframe holds the latch lever in the engaged position, thereby indirectly engaging the mainframe with the bowstring latch and holding the bowstring latch in the bolt-present position against the bias on the bowstring latch.

Example 5. The anti-dry-fire mechanism of Example 4 wherein the latch lever moves between the engaged and non-engaged positions by rotation of the latch lever.

Example 6. The anti-dry-fire mechanism of Example 4 wherein the latch lever moves between the engaged and non-engaged positions by curvilinear movement of the latch lever.

Example 7. The anti-dry-fire mechanism of any one of Examples 4 through 6 wherein the latch lever includes at least one engagement surface arranged for engaging the mainframe, as the movable trigger subassembly moves to the brace position, and forcing movement of the bowstring latch to the bolt-present position against the bias on the bowstring latch.

Example 8. The anti-dry-fire mechanism of Example 7 wherein the at least one engagement surface of the latch lever includes at least one curved, sloped, inclined, or beveled engagement surface.

Example 9. The anti-dry-fire mechanism of any one of Examples 4 through 8 wherein the latch lever is biased toward the engaged position, and bias force on the latch lever is insufficient to move the bowstring latch to the bolt-present position against bias on the bowstring latch.

Example 10. The anti-dry-fire mechanism of any one of Examples 1 through 3 wherein the mainframe and the bowstring latch are arranged so that, with the movable trigger subassembly in the brace position, direct engagement of the mainframe with the bowstring latch holds the bowstring latch in the bolt-present position against the bias on the bowstring latch.

Example 11. The anti-dry-fire mechanism of any one of Examples 1 through 10 wherein the bowstring latch moves between the engaged and non-engaged positions by rotation of the bowstring latch.

Example 12. The anti-dry-fire mechanism of any one of Examples 1 through 10 wherein the bowstring latch moves between the engaged and non-engaged positions by curvilinear movement of the bowstring latch.

Example 13. The anti-dry-fire mechanism of any one of Examples 1 through 12 wherein: (e) the movable trigger subassembly further includes a sear movable between a firing sear position and a non-firing sear position and biased toward the non-firing sear position; and (f) the bowstring catch and the sear are arranged so that (i) with the sear in the non-firing sear position, the sear is arranged to obstruct movement of the bowstring catch away from the non-firing catch position, and (ii) with the sear in the firing sear position, the sear is arranged to permit movement of the bowstring catch to the firing catch position in response to bias on the bowstring catch and thereby cause release of the bowstring.

Example 14. The apparatus of Example 13 further comprising a stationary trigger subassembly of the crossbow attached to the mainframe at a rearward end thereof, wherein: (g) the stationary trigger subassembly includes (i) a trigger movable between a firing trigger position and a non-firing trigger position and biased toward the non-firing trigger position, and (ii) an actuator coupled to the trigger and movable between a firing actuator position and a non-firing actuator position; (h) the trigger and the actuator are arranged so that (i) movement, against bias on the trigger, of the trigger to the firing trigger position causes movement of the actuator to the firing actuator position, and (ii) with the movable trigger subassembly in the drawn position, movement of the actuator to the firing actuator position causes movement of the sear, against bias on the sear, to the firing sear position; and (i) with the movable trigger subassembly in the drawn position and a bowstring of the crossbow retained by the bowstring catch, the trigger, the actuator, the sear, and the bowstring catch are arranged so that (i) movement of the trigger causes movement of the actuator, (ii) movement of the actuator causes movement of the sear, (iii) movement of the sear permits movement of the bowstring catch, and (iv) movement of the bowstring catch releases the bowstring.

Example 15. The apparatus of Example 14 wherein the trigger and the actuator are integrally formed or rigidly connected to each other.

Example 16. The apparatus of Example 14 wherein the trigger and the actuator are coupled together so as to permit relative movement thereof.

Example 17. The apparatus of any one of Examples 14 through 16 wherein the bowstring catch includes a roller that engages the sear.

Example 18. The apparatus of any one of Examples 14 through 17 wherein the actuator includes a roller that engages the sear.

Example 19. The apparatus of any one of Examples 14 through 18 wherein the trigger and the actuator are arranged so that (i) with the movable trigger subassembly in the drawn position and the trigger held by the bias on the trigger in the non-firing trigger position, the actuator does not make contact with the sear, and (ii) with the movable trigger subassembly in the drawn position, movement of the trigger from the non-firing trigger position to the firing trigger position first causes the actuator to make contact with the sear and then causes the actuator to move the sear to the firing sear position.

Example 20. The apparatus of any one of Examples 14 through 19 wherein one or both of the stationary trigger subassembly or the movable trigger subassembly includes a trigger latch movable between a latched position and an unlatched position and arranged so as to, (i) in the latched position and with the movable trigger subassembly in the drawn position, obstruct movement of the movable trigger subassembly from the drawn position in the forward direction, and (ii) in the unlatched position, permit movement of the movable trigger subassembly from the drawn position in the forward direction.

Example 21. The apparatus of Example 20 wherein the trigger latch is biased toward the latched position.

Example 22. The apparatus of Example 21 wherein the trigger latch is arranged so as to be moved manually by a user of the crossbow to the unlatched position against bias on the trigger latch, thereby permitting movement of the movable trigger subassembly from the drawn position in the forward direction.

Example 23. The apparatus of any one of Examples 21 or 22 wherein the trigger latch is arranged so that movement of the movable trigger subassembly to the drawn position (i) first causes movement of the trigger latch toward the unlatched position against bias on the latch, and (ii) then permits the trigger latch to move to the latched position in response to bias on the latch, thereby obstructing movement of the movable trigger subassembly from the drawn position in the forward direction.

Example 24. The apparatus of any one of Examples 20 through 23 wherein, with the bowstring catch in the non-firing catch position retaining the bowstring, the movable trigger subassembly in the drawn position, and the trigger latch in the latched position, the trigger latch is arranged so as to hold the movable trigger subassembly in the drawn position against tension on the bowstring.

Example 25. The apparatus of any one of Examples 13 through 24 wherein the sear and the mainframe are arranged so that (i) with the movable trigger subassembly at intermediate positions along the mainframe, the mainframe blocks movement of the sear to the firing sear position, and (ii) with the movable trigger subassembly in the brace position or the drawn position, the mainframe does not obstruct movement of the sear to the firing sear position.

Example 26. The apparatus of any one of Examples 13 through 25 wherein the movable trigger subassembly further comprises a safety member movable between a safety-on position and a safety-off position and arranged so that (i) with the safety member in the safety-on position, the safety member obstructs movement of the sear from the non-firing sear position, and (ii) with the safety member in the safety-off position, the safety member does not obstruct movement of the sear to the firing sear position.

Example 27. A crossbow incorporating the apparatus of any one of Examples 1 through 26 further comprising a stock subassembly including the mainframe, a pair of bow limbs attached to a forward portion of the mainframe and disposed on opposite sides of the mainframe; and a bowstring connected to ends of the bow limbs.

Example 28. The crossbow of Example 27 wherein the bow limbs are attached directly to the forward portion of the mainframe.

Example 29. The crossbow of Example 27 further comprising a riser attached directly to the forward portion of the mainframe, wherein the bow limbs are attached to the riser.

Example 30. The crossbow of any one of Examples 27 through 29 wherein the bow limbs are arranged so that the crossbow is arranged as a recurve crossbow.

Example 31. The crossbow of any one of Examples 27 through 30 further comprising a pair of pulley members and one or more cables coupled to one or both pulley members or to the bow limbs, the mainframe, or a riser, wherein each pulley member is rotatably mounted on a corresponding one of the bow limbs, and the bowstring and the one or more cables are each engaged with one or both pulley members so that the crossbow is arranged as a compound crossbow.

Example 32. The crossbow of any one of Examples 27 through 31 further comprising a winch subassembly mounted in the stock subassembly, wherein the winch subassembly includes a spool, a crank handle coupled to rotate the spool, and a rope coupled to the movable trigger subassembly so that (i) rotation of the spool to take up the rope causes movement of the movable trigger subassembly in a rearward direction along the mainframe in response to tension on the rope, and (ii) rotation of the spool to let out the rope permits movement of the movable trigger subassembly in a forward direction along the mainframe.

Example 33. The crossbow of Example 32 wherein the crank handle is detachable from the spool.

Example 34. The crossbow of any one of Examples 32 or 33 wherein winch subassembly further comprises a clutch arranged so that (i) with the clutch engaged, the spool can rotate only to take up the rope, and (ii) with the clutch disengaged, the spool can rotate to take up or let out the rope.

Example 35. The crossbow of Example 34 wherein the clutch is biased toward engagement, and can be disengaged by movement against bias on the clutch.

Example 36. The crossbow of any one of Examples 34 or 35 wherein the clutch includes a sprag clutch.

Example 37. The crossbow of any one of Examples 34 or 35 wherein the clutch includes a ratchet and pawl.

Example 38. The crossbow of any one of Examples 32 through 37 wherein the rope is connected directly to the movable trigger subassembly so that, with the bowstring retained by the bowstring catch, operation of the winch to move the movable trigger subassembly in the rearward direction and draw the crossbow results in force applied to the movable trigger subassembly that is about equal to tension on the rope.

Example 39. The crossbow of any one of Examples 32 through 37 wherein the movable trigger subassembly includes a pulley, and the rope is looped around the pulley and connected directly to the stationary trigger subassembly or the stock subassembly so that, with the bowstring retained by the bowstring catch, operation of the winch to move the movable trigger subassembly in the rearward direction and draw the crossbow results in force applied to the movable trigger subassembly that is about two times larger than tension on the rope.

Example 40. A method for using the crossbow of any one of Examples 27 through 39, the method comprising: (A) with the movable trigger subassembly in the brace position, moving the bowstring catch to the non-firing catch position to retain the bowstring 50; (B) moving the movable trigger subassembly to the drawn position against tension on the bowstring, thus drawing the crossbow; (C) holding the movable trigger subassembly in the drawn position against the tension on the bowstring; (D) placing a bolt on the slot over the bowstring latch, forcing the bowstring latch into the bolt-present position; and (E) moving the trigger to the firing trigger position, thereby moving the actuator to the firing actuator position, moving the sear to the firing sear position, permitting the bowstring catch to move to the firing catch position, releasing the bowstring, and firing the crossbow to launch the bolt.

Example 41. The method of Example 40 further comprising, after part (E), moving the movable trigger subassembly to the brace position.

Example 42. The method of any one of Examples 40 or 41 comprising: after part (A) and before part (B), moving the safety member to the safety-on position; and after part (D) and before part (E), moving the safety member to the safety-off position.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An anti-dry-fire mechanism for a crossbow, the mechanism comprising (i) an elongated mainframe of the crossbow, the mainframe having a longitudinal slot, and (ii) a movable trigger subassembly of the crossbow, wherein:

(a) the movable trigger subassembly includes a body engaged with the slot of the mainframe, a bowstring catch, and a bowstring latch, and engagement of the body with the slot of the mainframe enables bidirectional movement of the movable trigger subassembly along the mainframe between a forward brace position and a rearward drawn position;

(b) the bowstring catch is movable between a firing catch position and a non-firing catch position and arranged so that (i) with the bowstring catch in the non-firing catch position, the bowstring catch is arranged to retain a bowstring of the crossbow, and (ii) with the bowstring catch in the firing catch position, the bowstring catch is arranged to release the bowstring;

(c) the bowstring latch is positioned forward of the bowstring catch, movable between a bolt-present position and a bolt-absent position, biased toward the bolt-absent position, and arranged so that (i) with the bowstring latch in the bolt-absent position, the bowstring latch obstructs forward movement of the bowstring past the bowstring latch, (ii) with the bowstring latch in the bolt-present position, the bowstring latch does not obstruct forward movement of the bowstring past the bowstring latch, (iii) with the movable trigger subassembly in the drawn position and a bolt loaded onto the mainframe and positioned over the bowstring latch, the bolt holds the bowstring latch in the bolt-present position against bias on the bowstring latch, and (iv) with the movable trigger subassembly in the drawn position and no bolt loaded onto the mainframe, the bowstring latch is held in the bolt-absent position by the bias on the bowstring latch; and (d) the mainframe and the bowstring latch are arranged so that, with the movable trigger subassembly in the brace position, direct or indirect engagement of the mainframe with the bowstring latch holds the bowstring latch in the bolt-present position against the bias on the bowstring latch.

2. The anti-dry-fire mechanism of claim 1 wherein the mainframe includes at least one engagement surface arranged for engaging the bowstring latch, as the movable trigger subassembly moves to the brace position, and forcing movement of the bowstring latch to the bolt-present position against the bias on the bowstring latch.

3. The anti-dry-fire mechanism of claim 2 wherein the at least one engagement surface of the mainframe includes at least one curved, sloped, inclined, or beveled engagement surface.

4. The anti-dry-fire mechanism of claim 1 wherein (i) the movable trigger subassembly includes a latch lever movable between an engaged position and a non-engaged position, (ii) with the latch lever in the non-engaged position, the latch lever permits the bowstring latch to move to the bolt-absent position, (iii) with the latch lever held in the engaged position by engagement with the mainframe, the latch lever holds the bowstring latch in the bolt-present position against the bias on the bowstring latch, and (iv) the mainframe and the latch lever are arranged so that, with the movable trigger subassembly in the brace position, engagement of the latch lever with the mainframe holds the latch lever in the engaged position, thereby indirectly engaging the mainframe with the bowstring latch and holding the bowstring latch in the bolt-present position against the bias on the bowstring latch.

5. The anti-dry-fire mechanism of claim 4 wherein the latch lever moves between the engaged and non-engaged positions by rotation of the latch lever.

6. The anti-dry-fire mechanism of claim 4 wherein the latch lever includes at least one engagement surface arranged for engaging the mainframe, as the movable trigger subassembly moves to the brace position, and forcing movement of the bowstring latch to the bolt-present position against the bias on the bowstring latch.

7. The anti-dry-fire mechanism of claim 6 wherein the at least one engagement surface of the latch lever includes at least one curved, sloped, inclined, or beveled engagement surface.

8. The anti-dry-fire mechanism of claim 4 wherein the latch lever is biased toward the engaged position, and bias force on the latch lever is insufficient to move the bowstring latch to the bolt-present position against bias on the bowstring latch.

9. The anti-dry-fire mechanism of claim 1 wherein the mainframe and the bowstring latch are arranged so that, with the movable trigger subassembly in the brace position, direct engagement of the mainframe with the bowstring latch holds the bowstring latch in the bolt-present position against the bias on the bowstring latch.

10. The anti-dry-fire mechanism of claim 1 wherein the bowstring latch moves between the engaged and non-engaged positions by rotation of the bowstring latch.

11. The anti-dry-fire mechanism of claim 1 wherein:

(e) the movable trigger subassembly further includes a sear movable between a firing sear position and a non-firing sear position and biased toward the non-firing sear position;

(f) the bowstring catch and the sear are arranged so that (i) with the sear in the non-firing sear position, the sear is arranged to obstruct movement of the bowstring catch away from the non-firing catch position, and (ii) with the sear in the firing sear position, the sear is arranged to permit movement of the bowstring catch to the firing catch position in response to bias on the bowstring catch and thereby cause release of the bowstring.

12. The apparatus of claim 11 further comprising a stationary trigger subassembly of the crossbow attached to the mainframe at a rearward end thereof, wherein:

(g) the stationary trigger subassembly includes (i) a trigger movable between a firing trigger position and a non-firing trigger position and biased toward the non-firing trigger position, and (ii) an actuator coupled to the trigger and movable between a firing actuator position and a non-firing actuator position;

(h) the trigger and the actuator are arranged so that (i) movement, against bias on the trigger, of the trigger to the firing trigger position causes movement of the actuator to the firing actuator position, and (ii) with the movable trigger subassembly in the drawn position, movement of the actuator to the firing actuator position causes movement of the sear, against bias on the sear, to the firing sear position; and (i) with the movable trigger subassembly in the drawn position and a bowstring of the crossbow retained by the bowstring catch, the trigger, the actuator, the sear, and the bowstring catch are arranged so that (i) movement of the trigger causes movement of the actuator, (ii) movement of the actuator causes movement of the sear, (iii) movement of the sear permits movement of the bowstring catch, and (iv) movement of the bowstring catch releases the bowstring.

13. The apparatus of claim 12 wherein one or both of the stationary trigger subassembly or the movable trigger subassembly includes a trigger latch movable between a latched position and an unlatched position and arranged so as to, (i) in the latched position and with the movable trigger subassembly in the drawn position, obstruct movement of the movable trigger subassembly from the drawn position in the forward direction, and (ii) in the unlatched position, permit movement of the movable trigger subassembly from the drawn position in the forward direction.

14. The apparatus of claim 13 wherein, with the bowstring catch in the non-firing catch position retaining the bowstring, the movable trigger subassembly in the drawn position, and the trigger latch in the latched position, the trigger latch is arranged so as to hold the movable trigger subassembly in the drawn position against tension on the bowstring.

15. The apparatus of claim 11 wherein the sear and the mainframe are arranged so that (i) with the movable trigger subassembly at intermediate positions along the mainframe, the mainframe blocks movement of the sear to the firing sear position, and (ii) with the movable trigger subassembly in the brace position or the drawn position, the mainframe does not obstruct movement of the sear to the firing sear position.

16. The apparatus of claim 11 wherein the movable trigger subassembly further comprises a safety member movable between a safety-on position and a safety-off position and arranged so that (i) with the safety member in the safety-on position, the safety member obstructs movement of the sear from the non-firing sear position, and (ii) with the safety member in the safety-off position, the safety member does not obstruct movement of the sear to the firing sear position.

17. A crossbow incorporating the apparatus of claim 1 further comprising a stock subassembly including the mainframe, a pair of bow limbs attached to a forward portion of the mainframe and disposed on opposite sides of the mainframe; and a bowstring connected to ends of the bow limbs.

18. The crossbow of claim 17 further comprising a winch subassembly mounted in the stock subassembly, wherein the winch subassembly includes a spool, a crank handle coupled to rotate the spool, and a rope coupled to the movable trigger subassembly so that (i) rotation of the spool to take up the rope causes movement of the movable trigger subassembly in a rearward direction along the mainframe in response to tension on the rope, and (ii) rotation of the spool to let out the rope permits movement of the movable trigger subassembly in a forward direction along the mainframe.

19. The crossbow of claim 18 wherein winch subassembly further comprises a clutch arranged so that (i) with the clutch engaged, the spool can rotate only to take up the rope, and (ii) with the clutch disengaged, the spool can rotate to take up or let out the rope.

* * * * *